US006491379B1

(12) United States Patent
Kawaguchi et al.

(10) Patent No.: US 6,491,379 B1
(45) Date of Patent: Dec. 10, 2002

(54) RECORDING HEAD AND IMAGE RECORDING APPARATUS UTILIZING THE RECORDING HEAD

(75) Inventors: Koji Kawaguchi, Chiba (JP); Tatsuru Sato, Chiba (JP); Seiji Kuwahara, Chiba (JP); Hiroyuki Muramatsu, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/310,909

(22) Filed: May 13, 1999

(30) Foreign Application Priority Data

May 20, 1998 (JP) ..... 10-138891
May 14, 1998 (JP) ..... 10-132340
Mar. 30, 1999 (JP) ..... 11-089679

(51) Int. Cl.[7] ..... B41J 2/06

(52) U.S. Cl. ..... 347/55

(58) Field of Search ..... 347/55, 151, 120, 347/141, 154, 103, 123, 111, 159, 127, 128, 131, 125, 116, 117, 115, 73, 213; 399/271, 290, 293, 294, 295

(56) References Cited

U.S. PATENT DOCUMENTS 6,126,274 A * 10/2000 Kohyama ..... 347/55

OTHER PUBLICATIONS

Patent Abstracts of Japan, vol. 011, No. 172 (M–595) Jun. 3, 1987.
Patent Abstracts of Japan, vol. 005, No. 043 (M–060), Mar. 23, 1981.
Patent Abstracts of Japan, vol. 1997, No. 07, Jul. 3, 1997.
Patent Abstracts of Japan, vol. 007, No. 197 (M–239), Aug. 27, 1983.
Patent Abstracts of Japan, vol. 1998, No. 04, Mar. 31, 1998.
Patent Abstracts of Japan, vol. 1997, No. 07, Jul. 31, 1997.

* cited by examiner

*Primary Examiner*—Raquel Yvette Gordon
(74) *Attorney, Agent, or Firm*—Adams & Wilks

(57) ABSTRACT

A recording head has a head portion having a common electrode, an ink chamber for storing ink, and an ink ejection port. A counter electrode is disposed opposite to and spaced-apart from the common electrode and proximate the ink ejection port of the head portion to form a gap between the counter electrode and the ink ejection port for receiving a recording medium. The counter electrode has recording electrodes extending generally perpendicular to a lengthwise direction of the common electrode. A power source applies a voltage between the common electrode and the counter electrode to generate an electric field therebetween. A control circuit independently controls the voltage applied to each of the recording electrodes to generate an electrostatic force for electrically charging the ink disposed in the ink chamber so that the electrically charged ink flows from the ink chamber, is ejected through the ejection port, and is outputted onto the recording medium.

16 Claims, 13 Drawing Sheets

RECORDING HEAD AND IMAGE RECORDING APPARATUS UTILIZING THE RECORDING HEAD

BACKGROUND OF THE INVENTION

The present invention relates to an inkjet recording apparatus for providing output images on recording media, which can satisfy a wide range of needs in the printing industry wherein high quality images must be output at a high speed, needs in the printer industry that are based on requirements in offices and personal requirements and, further, needs in consumer product industries wherein inexpensive and versatile output equipment and the like utilizing various types of recording paper for various purposes are required.

As a conventional electrostatic type inkjet recording system, a slit-jet recording system has been disclosed (Susumu Ichinose et al.: "Slit-Jet Recording System", Paper at the First Symposium on Non-Impact Printing Techniques, pp. 119–124, 1984). A description will be made on the slit-jet system based on the side view in FIG. 9*a* and the perspective view in FIG. 9*b*.

As shown in FIGS. 9*a*, 9*b*, a recording head is constituted by a head portion 911 and a counter electrode portion 912 proposed in a face-to-face relationship with said head portion 911. The head portion 911 is constituted by an ink ejection port 901 formed like a slit, an upper substrate 902 and a lower substrate 903 that form said ink injection port 901, recording electrodes 904 provided on said lower substrate 903 in units of pixels, a control circuit 907 for switching the ejection of ink from the position of each of the recording electrodes 904 based on a recording signal, and a high voltage power supply 906 for supplying a constant voltage pulse to electrodes selected from among said recording electrodes 904, to cause a potential difference between the counter electrode portion 912 and them when the voltage is applied.

The counter electrode portion 912 is constituted by a support body 917 and a common electrode 905 provided on the support body 917 and is provided in a face-to-face relationship with said ink ejection port 901 with a predetermined microscopic gap therebetween and, further, recording paper 910 is inserted in said microscopic gap.

Ink 908 having high resistance is charged in the ink ejection port 901 of said head portion 911, and the head portion 911 and counter electrode portion 912 are driven. Then, as a result of the application of a constant voltage pulse to said recording electrodes 904 as shown in FIG. 9*a*, charges are supplied from the recording electrodes 904 to the ink in regions where the ink is to be ejected, and an electric field is generated between the recording electrodes 904 and common electrode 905. The ink 908 receives a Coulomb force in the electric field thus generated to be ejected toward the counter electrode portion 912, and flown ink 909 sticks on to and penetrates into recording paper 910 to provide a desired image output.

According to such a conventional slit-jet recording system, it is possible to avoid limitations on resolution placed by nozzles and to facilitate the cleaning of said ink ejection port 901 by replacing nozzles used for inkjet recording with said ink ejection port 901 in the form of an elongate slit.

Further, according to the slit-jet recording system, color output printing can be easily achieved by using a plurality of said recording heads and supplying each of the ink ejection ports 901 with said ink 908 in a different color and driving it based on a recording signal.

However, conventional recording heads and recording apparatuses according to the slit-jet recording system have had the following problems.

(1) The head portion has integrated functions of wiring to recording electrode patterns divided on the basis of recording pixels and to the circuit for controlling and driving said electrodes independently, an ink chamber for storing a predetermined amount of ink and ink supply means such as an ink tank or ink supply path; the head portion has a very complicated structure which reduces the yield of production.

(2) The durability of the head portion is low because the divided recording electrodes at the head portion are always in direct contact with ink to supply electric charges thereto and because the electrodes have such small divisions that they can be easily corroded by reactions such as electrolysis and oxidation.

(3) Since the constant voltage pulse is applied only to recording electrodes which are to cause the ejection of ink during printing, a large potential difference occurs between the recording electrodes which cause the ejection of ink and those which does not cause the ejection of ink. No insulation treatment can be performed on the surface of the recording electrodes because they supply electric charges to ink and, in addition, adjoining recording electrodes are electrically connected through ink. As a result, a voltage drop can occur between the adjoining electrodes, which disables the generation of the potential difference required for the ejection of ink to reduce the selectivity of ink ejecting positions. A possible solution to this is to increase the potential difference supplied between the electrodes in advance. In this case, however, there is a risk of discharge between adjoining recording electrodes or between the recording electrodes and the common electrode on the counter electrode portion.

(4) Since the electric field generated in the recording head is generated by applying a voltage to divided recording electrodes at the head portion and the common electrode at the counter electrode portion, the electrostatic fields in the regions to which the voltage is applied during the operation concentrate at the head portion where the divided thin electrodes are arranged and spread in the form of a plane at the counter electrode. Therefore, while the ink ejecting positions at the ink ejection port in the head portion is accurately positioned, the landing positions of ink flying toward the counter electrode portion are unstable because of the spread of the electric field. This increases the possibility of misalignment of ink dots as an output image for an apparatus, which makes it difficult to provide a high quality output.

(5) Multi-color printing such as color printing can be performed at least by arranging recording heads associated with respective colors and by driving them independently. However, since this necessitates a recording head and a driving circuit for each color and, the cost and size of an apparatus are increased.

(6) When adjoining recording electrodes are simultaneously driven, i.e., when voltages having the same polarity are applied to adjoining recording electrodes, an interaction occurs between ejected ink droplets, which results in a phenomenon wherein recorded pixels are displaced from normal positions to reduce the quality of the image. Possible causes of this include the fact that turbulence occurs at electric fields generated simultaneously between adjoining electrodes toward the counter electrode as a result of significant mutual influence and the electric fields are not concentrated at the counter electrode which is a common electrode and the fact that physical continuation of ink attributable to ejection port formed like a slit has significant influence. Therefore, in order to avoid such an interaction between adjoining electrodes, divided driving methods have conventionally been used in which recording electrodes are sequentially driven at intervals of several lines, which has inevitably resulted in a reduction of recording speed.

(7) The principle behind the ejection of ink during electrostatic type inkjet recording is the fact that ink in the vicinity of said recording electrodes is charged when a voltage is applied between the recording electrodes and common electrodes, and the ink in said region receives a Coulomb force from electric fields generated between both of the electrodes to be ejected toward the counter electrode.

A Coulomb force F that acts when ink is ejected depends on the strength E of the electric fields generated between both of the electrodes and the amount q of the charges at the ink in the head portion as expressed by an equation $F=qE$. If it is assumed here that the amount q of the charges at the ink is constant, a Coulomb force F varies depending on the strength E of the electric fields generated between both of the electrodes.

During actual printing, however, as a result of the insertion of a recorded medium between both of the electrodes, the strength of the electric fields generated between the surface of the recorded medium and the recording electrodes varies depending on, for example, the characteristics of the recorded medium, e.g., the electrical characteristics such as the dielectric constant and resistance and geometrical characteristics such as the thickness and surface conditions, and this can affect printing.

Especially, in the case of paper which is most generally used as a recorded medium, it is difficult to obtain a stable potential distribution because of irregularities on the surface thereof and variation of the thickness thereof attributable to the fact that it is constituted by organic fiber. In addition, paper is susceptible to environmental factors such as temperature and humidity and is subjected to significant fluctuations of the electrical and geometrical characteristics including, for example, reduction in the volume resistivity and the occurrence of geometrical expansion and contraction and wrinkles as a result of the absorption of moisture. As a result, it is difficult to achieve stable strength of the electric fields.

As apparent from the above, in order to output a high quality image according to the conventional method, it has been necessary to prepare a dedicated recorded medium having stable electrical and geometrical characteristics to suppress the effects as described above, to further control the temperature and humidity in the apparatus and to control factors that contribute to the ejection of ink such as the applied voltage depending on the type of the recorded medium.

(8) When the electrostatic type inkjet recording system as in the example of the prior art is used, the strength E of the electric fields to apply a Coulomb force to charged ink is expressed by $E=V/d$ where d represents the distance between the electrodes and V represents the potential difference. It is therefore important to keep the distance between the electrodes uniform in the longitudinal direction of the recording head and to set it at a predetermined value. During actual printing, since a recorded medium is inserted between both of the electrodes, the recorded medium is polarized by putting the recorded medium in tight contact with the counter electrode portion to be put into contact with the electrodes, and electrical charges having the same polarity as that of the potential applied to the common electrode appear on the surface thereof to generate stable electric fields between the surface of the recorded medium and the recording electrodes of the head portion.

In the case of a normal inkjet recording apparatus, since ink on the image recording side (hereinafter "front side") of the recorded medium has not been dried yet immediately after printing, a method is used wherein recorded medium transport means is provided before, i.e., upstream of, the recording head and wherein the front side of the recorded medium is lightly pressed by a roller having a small contact area downstream of the same in order to minimize the contact between the recording head and itself. In the case of the electrostatic type inkjet recording system, however, since the recorded medium must be inserted into the microscopic gap between the head portion and counter electrode portion, such a mechanism of the recorded medium transport means contacts the ink ejection port of the head portion to smear the recorded medium when the recorded medium is deformed and also urges the recorded medium against the counter electrode portion with a small force t o cause an uneven contact state between them. As a result, the distribution of electrical fields becomes unstable to cause deterioration of images. Among methods to avoid this drawback are a method in which the recorded medium to be transported is secured to the counter electrode portion with, for example electrostatic absorption or air absorption means, a method in which the recorded medium to be transported is wound and rotated around a counter electrode portion formed like a drum, and a method in which the recorded medium is chucked and pulled at the end thereof to be transported . This results in a complicated transport mechanism and inevitably leads to an increase in material and manufacturing cost and also to an increase in the size of an apparatus.

SUMMARY OF THE INVENTION

A recording head according to the present invention has a configuration including a head portion constituted by an ink ejection port and a common electrode provided in the vicinity of said ink ejection port for supplying electric charges to ink, ink supply means for supplying ink to the ink ejection port through the common electrode in said head portion, a counter electrode portion provided with a microscopic gap from the ink ejection port of said head portion, recording electrodes formed on the surface of said counter electrode as divisions associated with pixels of a recorded image, voltage supply means for applying predetermined voltages between said common electrode and recording electrodes; and driving means for driving the recording electrodes by controlling the voltage applied to each of said recording electrodes in accordance with an image signal independently.

The invention also provides a recording apparatus having a configuration wherein said recording head is used and wherein recording paper transport means for supplying recording paper to the microscopic gap between the ink ejection port provided at said head portion and the counter electrode and for scanning it in synchronism with the driving of said recording head.

Specifically, the head portion of the recording head serves as a common electrode, and divided recorded electrodes are provided at the counter electrode, which improves yield because the structure of the head portion can be simplified to relax limitations on manufacture. Therefore, the maintenance of a recording head can be improved and the manufacturing cost can be reduced.

Since the recording electrodes are provided at the counter electrode, they will not contact ink and also an insulation treatment can be applied on the surface of the recording electrodes, which makes it possible to maintain a high level of insulation between adjoining recording electrodes. This makes it possible to prevent deterioration of the electrodes and discharge between the electrodes, thereby to expand the life of the recording head. In addition, since a great potential difference can be established between recording electrodes that cause the ejection of ink and recording electrodes that do not cause the ejection of ink, selectivity of ink ejecting positions can be stabilized.

Since electric fields concentrate at the recording electrodes on the counter electrode which are located at the end point in the ink ejecting direction, the accuracy of the landing positions of ink and the quality of an output image can be improved.

Furthermore, the simplified structure of the head portion makes it possible to easily configure the ink ejection port with a nozzle-shaped opening which is divided to accommodate each pixel. Since the ink ejection ports can be individually separated one by one in such a structure, physical continuation of ink acts little between adjoining nozzles. It is therefore possible to improve the accuracy of ink landing positions by canceling interactions between adjoining electrodes and to improve the quality of an output image. By suppressing interactions between adjoining electrodes with such a configuration, the recording head can be driven to accommodate one line simultaneously to realized an increase in recording speed.

Color images can be easily output by arranging a plurality of recording heads, driving them independently and scanning the recording paper in synchronism with the driving.

Color images can be output also by providing a single counter electrode portion in face-to-face relationship with a plurality of head portions and performing matrix driving of both of the electrodes. This makes it possible to make an apparatus compact and to reduce the cost of the apparatus.

This invention provides an intermediate transfer medium for receiving a recorded image on the surface of the counter electrode portion facing the head portion of said recording head and also provides retransfer means for causing ink dots ejected by said head portion to stick on to the surface of said intermediate transfer medium temporarily to transfer a desired image and for retransferring said image on to a recorded medium at a subsequent step. As a result, stable printing can be maintained because images are always recorded on the intermediate transfer medium. Further, since retransfer means is provided separately, printing can be carried out regardless of the type of the recorded medium and, as a result, transfer means of the recorded medium can be a simple mechanism which reduces the cost of the apparatus.

DETAILED DESCRIPTION OF THE PREFERRED EMBODIMENTS

Modes for carrying out the invention will now be described based on the drawings.

(Mode 1 of Carrying out the Invention)

Figures 1A, 1B:
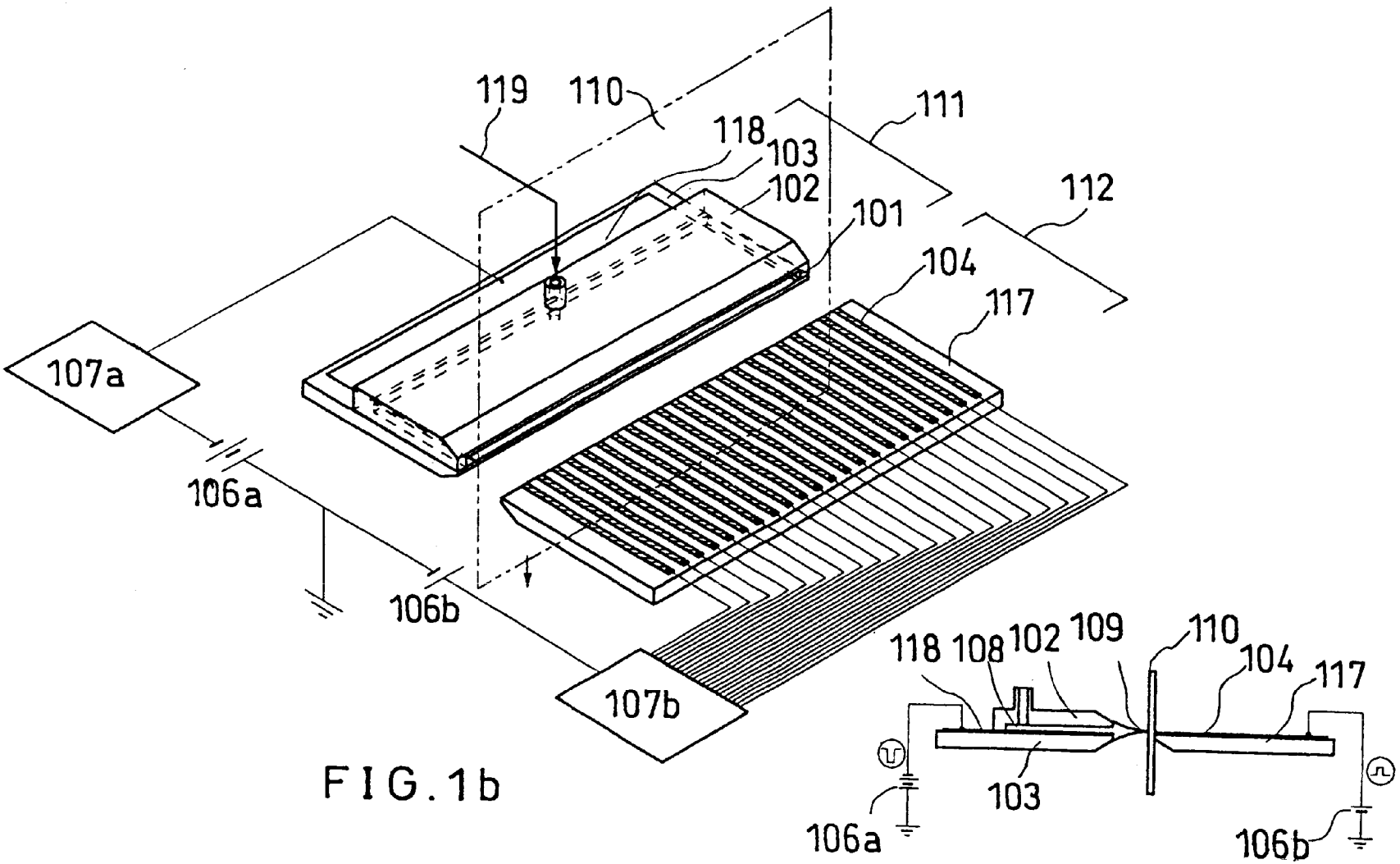
FIGS. 1*a* and 1*b* are illustrations showing a first configuration of a recording head in a mode 1 for carrying out the invention.

FIG. 1*a* is a side view and FIG. 1*b* is a perspective view showing a first configuration of a head portion 111 and a counter electrode portion 112 forming a recording head according to the invention.

The configuration of the head portion 111 will be first described based on FIGS. 1*a*, 1*b*.

103 represents a lower substrate which serves as a base of the head portion 111. A common electrode 118 in the form of a thin film is formed in a wide range on the upper surface of the lower substrate 103 and is wired to a high voltage power supply 106*a* through a driving circuit 107*a* which is driving means. An upper substrate 102 is secured on said lower substrate 103 by means such as bonding with a spacer having a uniform thickness interposed.

At this time, the spacer is provided such that it surrounds the end face of the lower substrate 103 forming an ink ejection port within the U-shaped configuration thereof. With such an integrated configuration of the head portion 111, a gap having a constant height determined by the thickness of said spacer is formed between both of the substrates as an ink chamber to be filled with ink, and a slit-shaped opening 101 (hereinafter referred to as "slit ejection port") is formed at the counter electrode portion 112 facing the head portion 111.

An opening 119 for supplying ink 108 to said ink chamber is provided on the upper substrate 103 and is connected to ink supply means (not shown) constituted by an ink supply tank and a supply tube. The ink 108 is supplied by ink supply means through the opening 119 and the ink chamber to the slit ejection port 101 under a substantially constant pressure (hereinafter referred to as "static pressure") originating from the weight of the ink itself and the atmospheric pressure. The static pressure acting on the ink 108 balances the surface tension of the ink at the slit ejection port 101 to form a semilunar convex, i.e., meniscus and stays in this state.

Further, as shown in FIG. 1*a*, the region of the head portion 111 forming the slit ejection port 101 has a wedge-shaped section and has a structure to provide a thin meniscus that causes electrical fields to concentrate on the ink.

In the case of the electrostatic type inkjet recording system with a slit ejection port, it is important to maintain a stable shape of an ink meniscus in order to stabilize the ejection of ink. Since the accuracy of the shape of the slit ejection port and the contact angle thereof with ink are major factors to stabilize the shape of an ink meniscus, it is obviously desirable that the accuracy of the shape of the region forming the slit ejection port 101 is high and that the contact angle with ink is great. Therefore, for example, the surface of the lower substrate 103 and upper substrate 102 of the head portion 111 made of an insulating material such as glass or ceramics may be treated using a silane coupling agent or the like to maintain a great contact angle and a stable meniscus shape. Since this stabilizes the surface conditions of ink at the slit ejection port 101, the flying direction of ink is controlled and, the amount and speed of ejected ink are stabilized. Further, by controlling the curve of an ink meniscus, the efficiency of ink concentration can be improved to reduce energy for the flight of ink.

In the present mode of carrying out the invention, glass substrates having insulating properties and high surface accuracy are used as the lower substrate 103 and upper substrate 102 of the head portion 111 to configure the shape of the slit ejection port 101 accurately, and the surface treatment as described above is applied in the vicinity of the slit ejection port 101. A method is used in which aluminum is vacuum-deposited on the upper surface of the lower substrate 103 and a chemical etching process is performed thereafter on the aluminum thin film to form the common electrode.

Since it is only required that the head portion 111 include the common electrode 118 for supplying electric charges to ink according to the present invention, for example, the lower substrate 103 itself may be formed from a metal material as long as the conditions for the accuracy of the shape of the slit ejection port 101 and the contact angle with ink are satisfied as described above. However, since a high voltage is applied to the common electrode 118, it is desirable in this case that it is coated with an insulator on the periphery thereof in order to avoid discharge and electrical contact with other members and the like. While the common electrode 118 is formed using aluminum as the material in the present mode for carrying out the invention, this is not especially limiting, and metal materials such as copper, chrome, gold and nickel may be used. In addition, the common electrode 118 is not limitedly located on the lower substrate 103 and, for example, it may be provided in any position in contact with the ink 108 to be able to supply electric charges thereto, e.g., the upper substrate 102.

A configuration of the counter electrode portion 112 will now be described based on FIGS. 1*a* and 1*b*.

117 represents a supporting body of a counter electrode which is provided in a face-to-face relationship with the slit ejection port 101 of the head portion 111 at a predetermined microscopic gap. Subdivided recording electrodes 104 are formed on the surface thereof such that they are arranged at the same pitch as the pixels of recorded images across substantially the same width as that of the slit ejection port 101 in said head portion 111 in the longitudinal direction thereof and such that the recording electrodes 104 face said slit ejection port 101 in the sectional direction thereof. Those recording electrodes 104 are configured such that they are individually controlled by the driving circuit 107*b* which is driving means to be able to apply a predetermined constant voltage pulse and are connected to the high voltage power supply 106*b* through said driving circuit 107*b*.

Since the recording electrodes 104 on the supporting body 117 of the counter electrode portion 112 are arranged at a high density of about 10–24/mm, a glass substrate which is an insulator having high plane accuracy was used as the supporting body 117 and the patterning of the recording electrodes 104 was fabricated by vacuum-depositing aluminum on the substrate and thereafter performing a chemical etching process on this aluminum thin film in this mode for carrying out the invention. Further, the surface of the recording electrodes 104 was coated with a protective layer which is an insulator in order to prevent discharge and contact between adjoining electrodes or discharge and contact with the common electrode 118 in the head portion 111 or members in the neighborhood.

While the recording electrodes 104 are formed using aluminum as the material in this mode for carrying out the invention, this is not especially limiting as in the case of the common electrode 118 in the head portion 111, and metal materials such as copper, chrome, gold and nickel may obviously be used.

The head portion 111 of said recording head is positioned with a microscopic gap of about 0.5–1 mm from the counter electrode portion 112. Recording paper 110 is inserted in said gap by recording paper transport means and, as a result, ink ejected from the head portion toward the counter electrode portion is deposited on the recording paper during recording. A transport mechanism such as a friction feed method utilizing a pair of rollers is used as the recording paper transport means to scan the recording paper intermittently or continuously in synchronism with the driving of the recording electrodes in the recording head.

Since it is difficult to insert the recording paper 110 in said microscopic gap, for example, it is preferable to provide, in said transport mechanism, a mechanism to cause said head portion 111 or counter electrode portion 112 to retract in the direction of expanding said microscopic gap and to return the microscopic gap to a predefined state after inserting and setting the paper in the gap.

Next, a description will be made on the connection of the wiring of the recording electrodes 104 and common electrode 118.

The negative pole side of the high voltage power supply 106*a* which is means for applying a first electric potential is connected via the driving circuit 107*a* to the common electrode 118 in the head portion 111. The positive pole side of the high voltage power supply 106*b* which is means for supplying a second electric potential is connected via the driving circuit 107*b* to the divided electrodes 104 in the counter electrode portion 112 though the driving circuit 107*b*.

Figure 6:
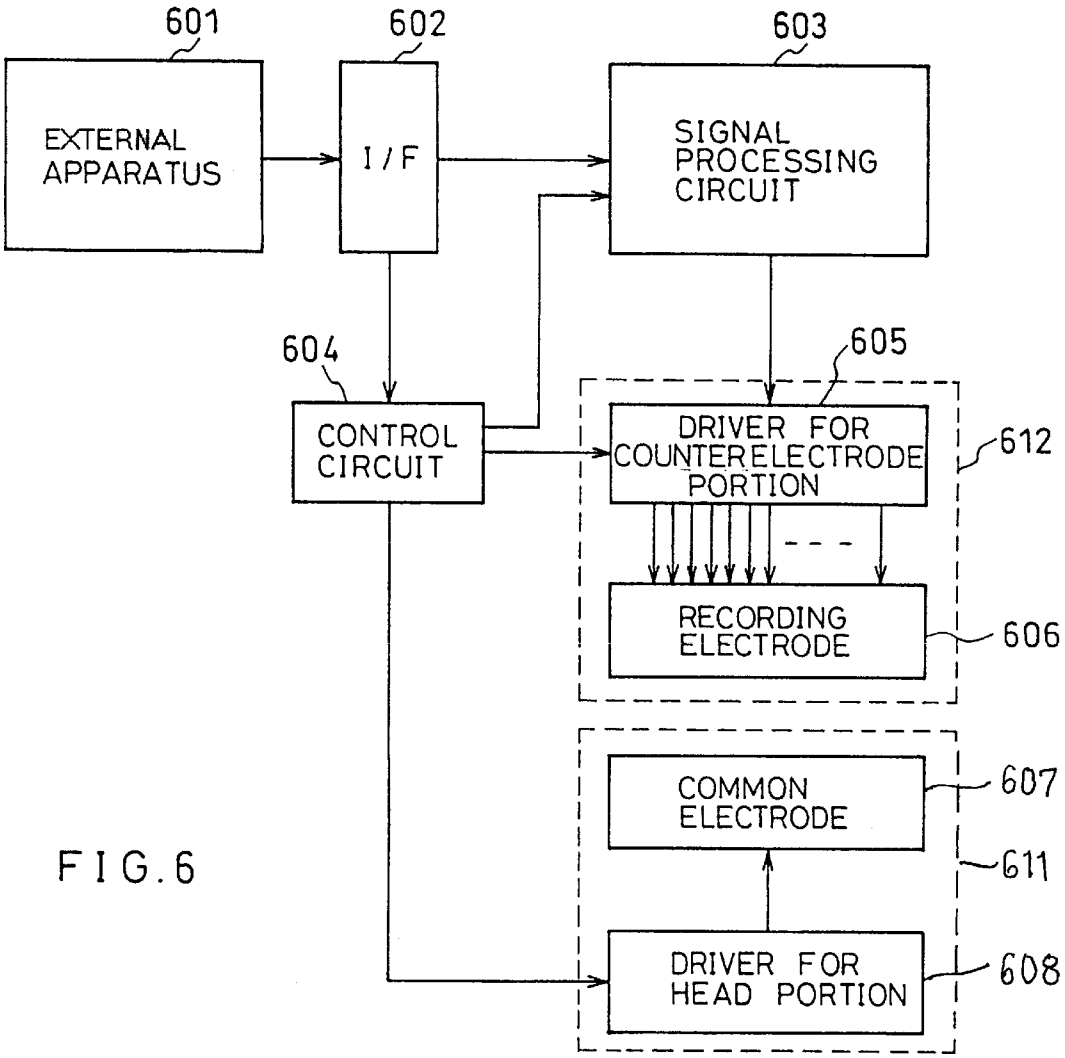
FIG. 6 is a block diagram showing a driving method utilizing the recording head shown in the mode 1 or 2 for carrying out the invention.

A description will now be made based on the block diagram shown in FIG. 6 on an example of a method for driving the recording head in which the electrodes are connected as described above.

First, parallel signals output from an external apparatus 601 such as a PC terminal are input to an interface 602 which is a gateway as a recording apparatus, and control signals comprising parallel image data signals, signals for controlling the apparatus and the like are output from said interface 602.

The parallel image data signals output from said interface 603 are input to a signal processing circuit 603. The control signals output through said interface 602 are input to a control circuit 604 and are converted into a control signal for timing and operating each of said signal processing circuit 603, a driver 605 for the counter electrode portion and a driver 608 for the head portion in synchronism.

In response to the control signals from said control circuit 604, said signal processing circuit 603 converts the parallel image data signals output from said interface 602 into serial binary signals which are input to the driver 605 for the counter electrode portion.

At this time, said driver 605 for the counter electrode portion incorporates a shift register type latch. Said image data signals for recording of one line are set based on the input of this shift register and, thereafter, a control signal for driving recording of one line is output from the control circuit 604. This driving operation causes the driver 608 for the counter electrode portion to supply a constant voltage pulse having the positive polarity for recording of one line to each of recording electrodes 606 simultaneously.

A similar control signal is input from the control circuit 604 to the driver 608 for the head portion in synchronism with the operation of driving said recording electrodes 606, and a constant voltage pulse having the polarity which is the reverse of that of the voltage applied to said recording electrodes 606 (negative polarity in this case) is supplied to a common electrode 607 to drive it.

In this case, the first electric potential applied to the common electrode 607 in the head portion 611 at this time is set at a negative voltage polarity and an absolute voltage within the range of 1.5–2 kV, whereas the second electric potential applied to the recording electrodes 606 in the counter electrode portion 612 is set at a positive voltage polarity and an absolute voltage within the range of 300–750 V. Further, a pulse application time of 1 ms was applied to both of them in synchronism, and driving was carried out with an application period of 3–4 ms. Since the set values shown here vary depending on the distance of the gap between the ink ejection port 101 of the head portion 111 and the recording electrodes 104 on the counter electrode portion 112, the solid-state properties of the ink, the structure of the end of the head and the like, the values are not limiting and, for example, the pulse application time and the like can be reduced to about 100 $\mu$m by adjusting them to thereby increasing the recording speed.

The operation for recording of one line has been described above, and the recording paper is gradually transported to a direction perpendicular to the driving direction of the recording head with this operation repeated sequentially. As a result, a desired image is output on the recording paper.

While a description has been made in the present mode of carrying out the invention on a method for driving recording of one line simultaneously to increase the printing speed, for example, it is obviously possible to drive the recording electrodes by performing time-division sequential scan thereon in response to a recording signal for recording of one line. In the case of the electrostatic type inkjet recording system having a slit opening, when a voltage is simultaneously applied to adjoining recording electrodes, electrical and physical continuation of ink in the slit can result in problems such as the occurrence of a voltage drop between the adjoining recording electrodes, disabled ejection attributable to the influence of stress in the ink originating from the surface tension and viscosity of the ink and the like and misalignment of landing positions on recording paper. In order to prevent these phenomena, it is obviously possible to employ a method wherein a plurality of drivers that drive with delays and to connect the recording electrodes to each of said drivers at intervals of a plurality of lines, thereby to drive them on a divided basis.

A description will be made on conditions for ink used in the present invention.

Physical properties of ink as factors that significantly contribute to the flight of ink include surface tension, viscosity and conductivity. Referring to the relationship between the surface tension and the maximum interval between ink droplets flying to said counter electrode (hereinafter referred to as "maximum recording interval"), the maximum recording interval increases as the surface tension decreases when the surface tension is within the range of 20–50 dyn/cm if it is assumed that the conductivity and viscosity are constant. Therefore, a resisting force that acts during the process of ink ejection decreases as the surface tension decreases, and ink can be ejected even in a weak electric field. Thus, the maximum recording interval can be increased. In general, aqueous ink has higher surface tension which is 72.8 dyn/cm (20° C.) in the case of pure water and 20 dyn/cm to 35 dyn/cm in the case of an organic solvent. It is therefore possible to use ink obtained by dissolving a dye in an organic solvent as ink according to the invention. Further, an anionic surface-active agent as a surface-active agent, a cationic surface-active agent, a non-ion surface active agent and the like may be dissolved in said ink to improve the surface tension, thereby to increase said maximum recording interval.

While the viscosity of said ink solvent may be selected in a wide range, a solvent having a boiling point of 200° C. or more is chosen to maintain shelf stability because solvents having low viscosity reduce the shelf stability of said ink because of high volatility. Referring to the relationship between the viscosity and the maximum recording interval, the maximum recording interval increases as the viscosity decreases if it is assumed that the surface tension and conductivity are constant. It is therefore possible to increase the maximum recording interval when the viscosity is low just as in the case of surface tension because the resisting force at the process of ink ejection decreases.

To eject said ink, electric charges must be charged from the common electrode in said head to the ink. A high resistance is therefore desirable. However, if the resistance is too high, the ejection of ink does not occur because the electric charges are dispersed in said ink before the electric charges charged to said ink reach the end of the ink meniscus. When the resistance is too low, the spread of electric charges is accelerated to cause ink to be ejected in places other than positions where ejection is to occur, to cause discharge at the common electrode and an adjacent recording electrode and to cause a voltage drop as a result of conduction to an adjacent electrode which makes it impossible to obtain a voltage sufficient for ejection. Therefore, the appropriate value of the ink volume resistance is preferably within the range of $1\times10^7$ to $1\times10^9$ ($\Omega\cdot$cm) according to the present invention.

Referring to the set values of ink characteristics described above, since the flight of ink depends on the voltage supplied between said common electrode and the recording electrodes on the counter electrode, the distance to said counter electrode and the structure of the head portion such as the slit width of the slit ejection port, it is obvious that the ranges of the characteristics such as the optimum surface tension, viscosity and resistance are not necessarily limited to said values. Further, since the ink used in the present mode for carrying out the invention had a property of being easily charged by a negative pole, the recording electrodes 104 and the common electrode 118 are connected to the positive and negative poles, respectively. However, this is no limiting and, if the ink charging polarity is positive for example, the voltage applied to the common electrode 118 and recording electrodes 606 also has the reverse polarity and a desired operation is similarly performed even with such setting. Since ink itself is a dielectric having a high resistance, even when a voltage is applied only to the recording electrodes 104 by grounding the common electrode 118, the surface of ink is polarized to have the polarity opposite to the polarity of the voltage applied to the recording electrodes 104. Thus, the method of connection also allows the ejection of ink. However, since a high voltage must be set to be applied to the recording electrodes in order to provide an electric potential difference sufficient to eject ink at this time, consideration must be taken to a discharge phenomenon between adjoining electrodes, one of which is applied with the electric potential and the other of which is not applied with the electric potential, and to the withstand voltage of the driving circuit 107 itself.

The recording operation of the apparatus will now be described based on FIGS. 1*a* and 1*b*.

The description is based on an assumption that the recording head of the present mode for carrying out the invention is a line head having a slit ejection port 101 which is substantially equal to the recording paper 110. A description will be made on the recording operation of the apparatus on an assumption that the direction of the line on the counter electrode portion 112 along which the recording electrodes 104 are aligned is referred to as "main scanning direction" and the direction perpendicular to said main scanning direction is referred to as "sub-scanning direction".

When the apparatus issues a printing command, a cleaning operation is first carried out as an initial operation by an ejection port cleaning mechanism (not shown) on the slit ejection port 101 in the head portion 111 to enable the recording head for the ejection of ink. When said cleaning operation is completed, the recording paper 110 is inserted into the microscopic gap formed by the head portion 111 and counter electrode portion 112 by a paper supply mechanism such as an automatic sheet feeder and a transport mechanism utilizing a pair of rollers and the like (not shown), and said transport mechanism is controlled using position detecting means such as a paper edge sensor to locate the part where recording is to be started.

When said initial operation is completed, driving for recording of one line is carried out as indicated by the operation of driving said recording head. Specifically, a constant voltage pulse having the negative polarity is applied to the common electrode 104 on the head portion 111 and, as a result, electric charges having the negative polarity are charged in the ink 108 to generate negative charges on the entire surface of the region of the meniscus at the slit ejection port 101. By applying a constant pulse having the positive polarity to the recording electrodes 104 in regions where printing is to take place simultaneously with the operation, a great potential difference is generated only between the common electrode 118 and the recording electrodes 104 to generate intense electric fields locally. At this time, the ink 108 charged with the negative polarity at the slit ejection port 101 is subjected to a Coulomb force as a result of the generation of electric fields; ink 109 is attracted by and flies toward the recording electrodes 104 to which the voltage has been applied and lands on the recording paper 110 interposed on the way. Thus, the ink 109 penetrates on the recording paper 110. At this time, since the electric fields generated from the common electrode 118 to the recording electrodes 104 converge at the recording electrodes 104, the ink lands in desired positions accurately.

After the recording of one line as described above, the recording paper 110 is transported in the direction of the arrow by an amount which is determined by a predetermined resolution in the sub-scanning direction, and the same recording operation is repeated for the second and subsequent lines. Thus, an image can be output on the recording paper 110 in a range defined by the width of the recording head and the scanned amount of the recording paper 110.

In this mode for carrying out the invention, the recording head is provided such that the direction in which the recording electrodes 104 in said recording head 111 provided in the recording head are arranged crosses the scanning direction of the recording paper 110, and said recording head is configured in the form of a line corresponding to the width of printing on the recording paper 110. Referring to the arrangement, the recording electrodes 104 of said recording head are arranged in a direction of arrangement orthogonal to the sub-scanning direction of the recording paper 110. However, this is not especially limiting, and they may be arranged such that they cross the scanning direction of the recording paper 110 diagonally. Such an arrangement makes it possible to match the timing of driving and to improve the resolution of output.

(Mode 2 of Carrying out the Invention)

Figures 2A, 2B:
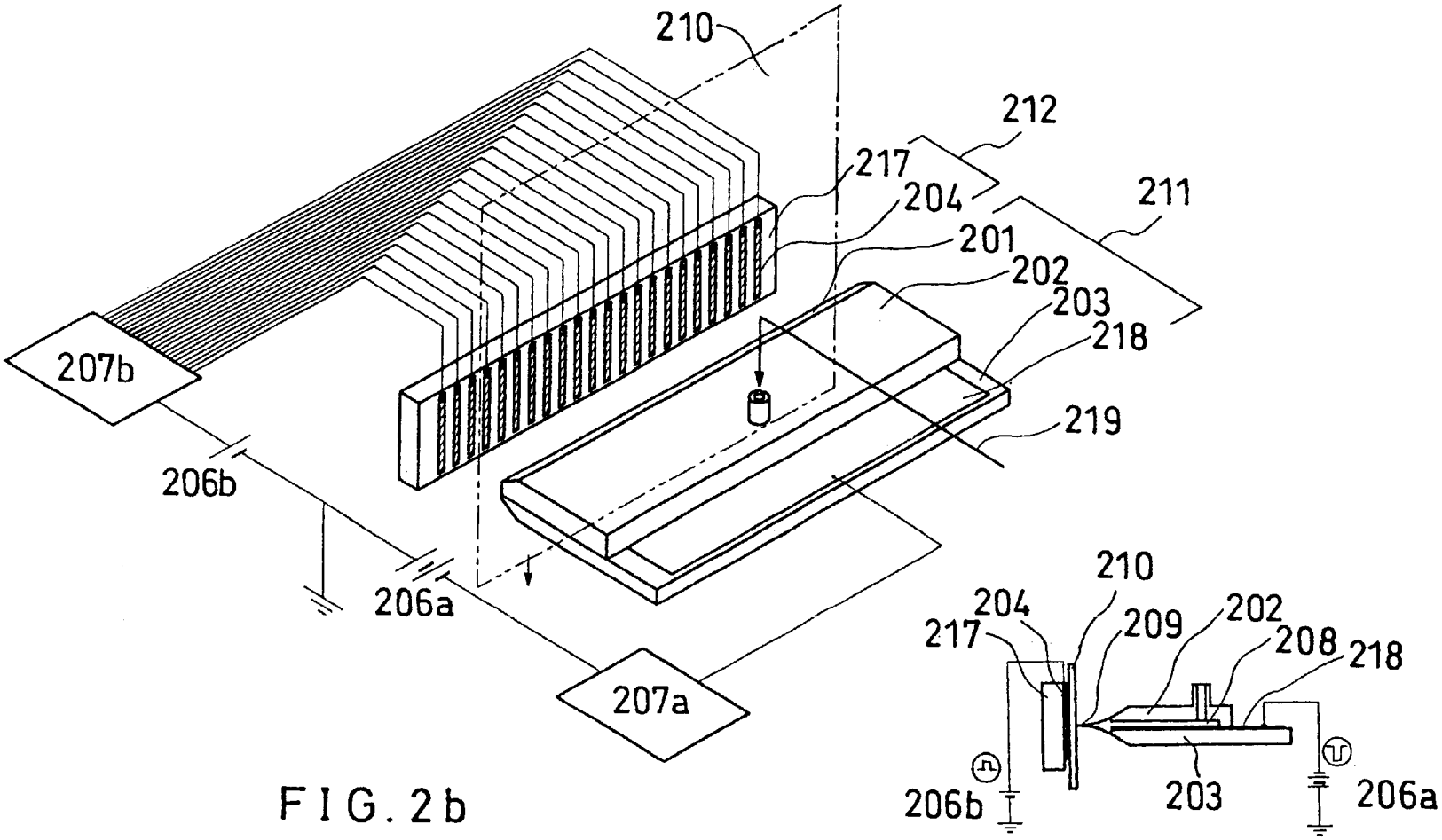
FIGS. 2*a* and 2*b* are illustrations showing a second configuration of a recording head in a mode 2 for carrying out the invention.

FIG. 2*a* is a side view and FIG. 2*b* is a perspective view showing a second configuration of a head portion and a counter electrode portion forming a recording head according to the invention.

The configuration of a head portion 211 will be first described based on FIGS. 2*a*, 2*b*.

203 represents a lower substrate which serves as a base of the head portion 211. A common electrode 218 in the form of a thin film is formed in a wide range on the upper surface of the lower substrate 203 and is wired to a high voltage power supply 206*a* through a driving circuit 207*a* which is driving means. An upper substrate 202 is secured on said lower substrate 203 by means such as bonding with a spacer having a uniform thickness interposed.

At this time, the spacer is provided such that it surrounds the end face of the lower substrate 203 forming an ink ejection port within the U-shaped configuration thereof. With such an integrated configuration of the head portion 211, a gap having a constant height determined by the thickness of said spacer is formed between both of the substrates as an ink chamber to be filled with ink, and a slit ejection port 201 is formed at a counter electrode portion 212 facing the head portion 211.

An opening 219 for supplying ink 208 to said ink chamber is provided on the upper substrate 203 and is connected to ink supply means (not shown) constituted by an ink supply tank and a supply tube. The ink 108 is supplied by ink supply means 219 through the ink chamber to the slit ejection port 201 under a static pressure. The static pressure acting on the ink 208 balances the surface tension of the ink at the slit ejection port 201 and said ink forms a semilunar convex, i.e., meniscus and stays in this state.

Further, as shown in FIG. 2*a*, the region of the head portion 211 forming the slit ejection port 201 has a wedge-shaped section and has a structure to provide a thin meniscus that causes electrical fields to concentrate on the ink.

A configuration of the counter electrode portion 212 will now be described based on FIGS. 2*a*, 2*b*.

217 represents a supporting body of a counter electrode which is provided in a face-to-face relationship with the slit ejection port 201 of the head portion 211 at a predetermined microscopic gap. Sub divided recording electrodes 204 are formed on the surface thereof such that they are arranged at the same pitch as the pixels of recorded images across substantially the same width as that of the slit ejection port 201 in said head portion 211 in the longitudinal direction thereof and such that the faces of said recording electrodes 204 vertically face the direction in which ink is ejected, i.e., such that the direction of the faces of the recording electrodes 104 face said slit ejection port 201. Those recording electrodes 204 are configured such that they are individually controlled by a driving circuit 107*b* which is driving means to be able to apply a predetermined constant voltage pulse and are connected to the high voltage power supply 206*b* through said driving circuit 207*b*.

In the case of an electrostatic type inkjet recording system having a slit ejection port, ink charged by electric fields generated at a microscopic gap formed between electrodes in the head portion and counter electrode portion is ejected under a Coulomb force. Therefore, in order to perform stable printing especially with a line head, it is important that the electric fields applied to said microscopic gap are uniform regardless of positions of the recording electrodes to which the voltage is applied.

When a voltage is applied between two electrodes, the electric field strength E is inversely proportionate to the distance between the electrodes. Since said distance between the electrodes is thus a factor that significantly contributes to the formation of a uniform electric field, a uniform electric field in said direction can be obtained by making the distance between the electrodes in the line direction uniform.

In the mode 1 for carrying out the invention, the slit ejection port and the recording electrodes are provided such that their sectional directions are matched. It is therefore necessary to perform positioning of the distance between them in the direction of the gap and the slit ejection port and the electrodes in the direction in which they are arranged in order to apply uniform electric fields between the common electrode and recording electrodes as described above.

However, when a counter electrode portion 212 having such a configuration as shown in the mode 2 for carrying out the invention is provided, it is required only to accurately adjust the distance between the common electrode and recording electrodes in the direction of the gap, and there is no need for positioning of the slit ejection port and electrodes in the direction in which they are arranged. This allows them to be easily incorporated in an apparatus with less adjustment.

Figure 3B:
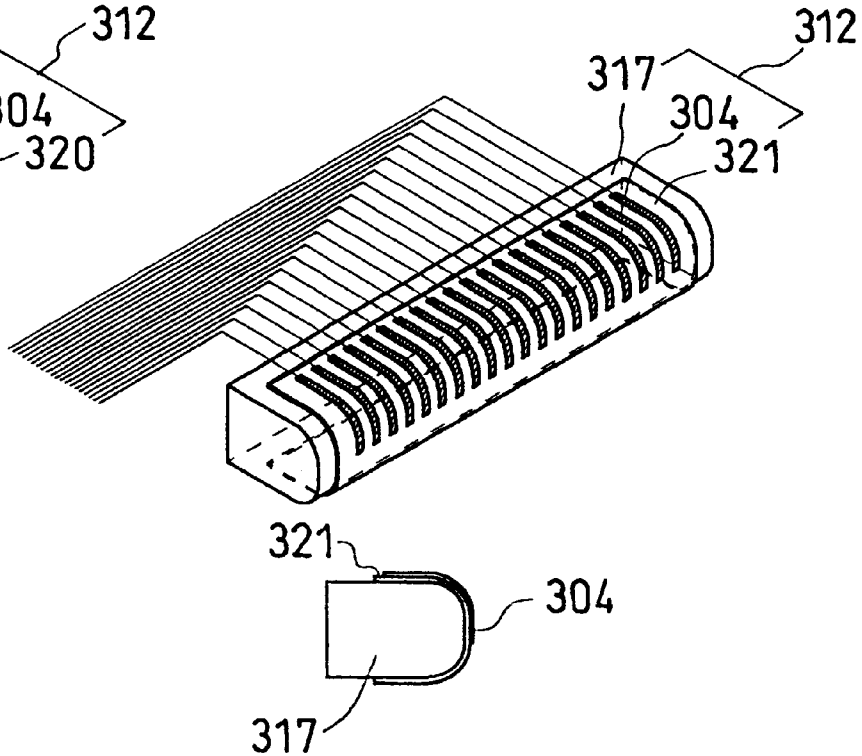
FIGS. 3*a* and 3*b* are illustrations showing a configuration of another example of a counter electrode portion in the modes 1 through 3 for carrying out the invention.
Figure 3A:
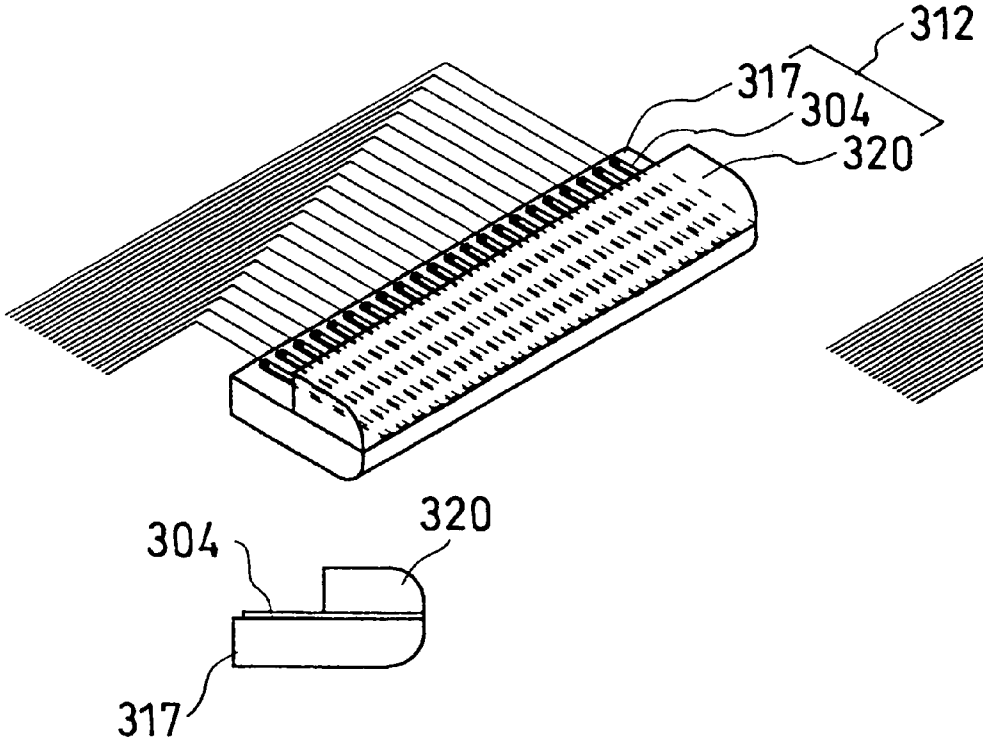

Another example of possible configurations of the counter electrode portion is shown in FIGS. 3*a*, 3*b*.

In FIG. 3*a*, similarly to the mode 1 for carrying out the invention, an electrode cover 320 which is an insulating member is tightly contacted and fixed on a support body 317 on which recording electrodes 304 are formed at the side of the recording electrodes 304 to be integrated therewith. Insulation between adjoining electrodes among the recording electrodes 304 is therefore sufficient, and this makes it possible to reduce risks such as discharge and to increase the voltage of a constant voltage pulse applied to the recording electrodes 304. That is, the coulomb force applied to ink can be increased by increasing the strength of the electric fields at regions where ink is to be ejected to allow stable printing.

In FIG. 3*b*, a counter electrode portion 312 is configured by applying a flexible substrate 321 to a support body 317. The counter electrode portion 312 can be fabricated at a low cost and easily replaced for maintenance and the like.

The ends of both of those described above may be formed as curved surfaces to use as guides for recording paper. By transporting recording paper along the curved surface at the end of said counter electrode portion with tension applied thereto, the recording paper is transported with a constant microscopic gap maintained between the head portion and itself. Thus, the paper can be easily and stably transported at the microscopic gap.

In the modes 1 and 2 for carrying out the invention, the head portion of the recording head has been described as a line head structure having the width of recording paper. Head portions having such a structure are not limiting and, for example, a serial driving system may be used in which one or more recording electrodes are arranged in the sub-scanning direction and in which recording is performed by transferring recording paper sequentially in the sub-scanning direction wile scanning the recording head in the main scanning direction.

In addition, the ejection port is not limited to the slit configuration, and it may be formed in the form of a plurality nozzles associated with recording pixels as described below.

Figure 10A:
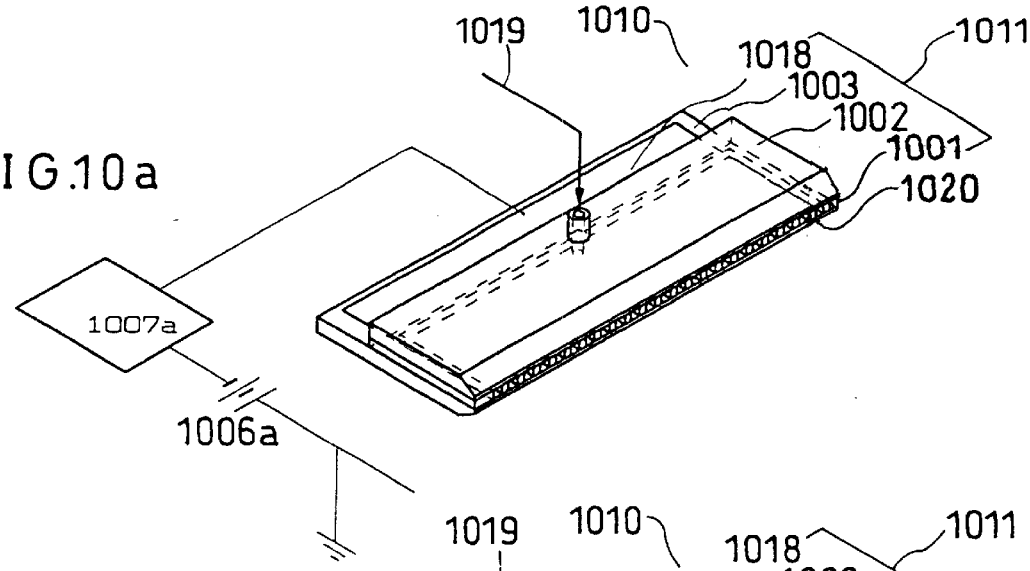
FIGS. 10*a*, 10*b* and 10*c* are illustrations showing a configuration of another example of the head portion in the modes 1 through 4 for carrying out the invention.
Figure 10B:
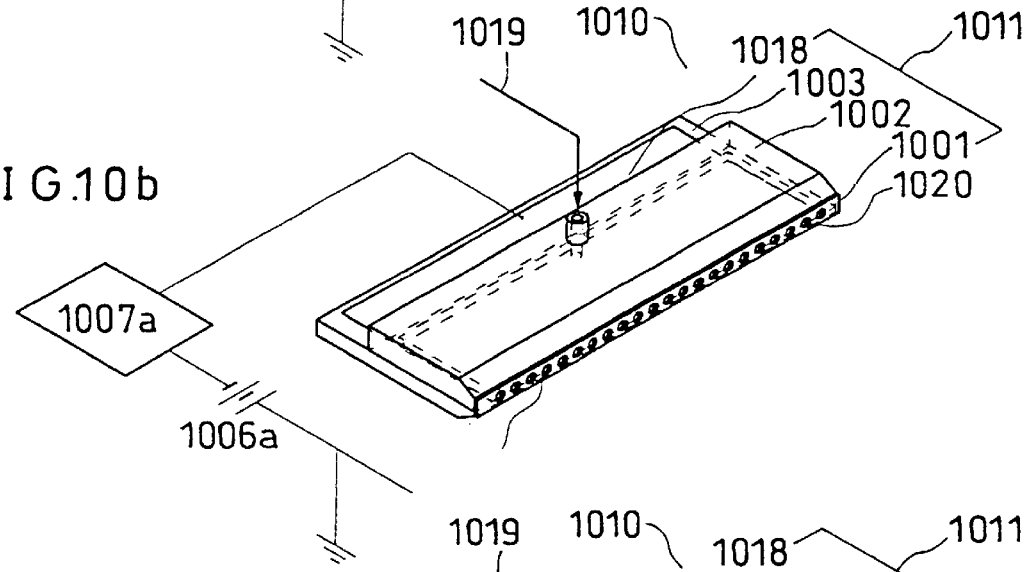
Figure 10C:
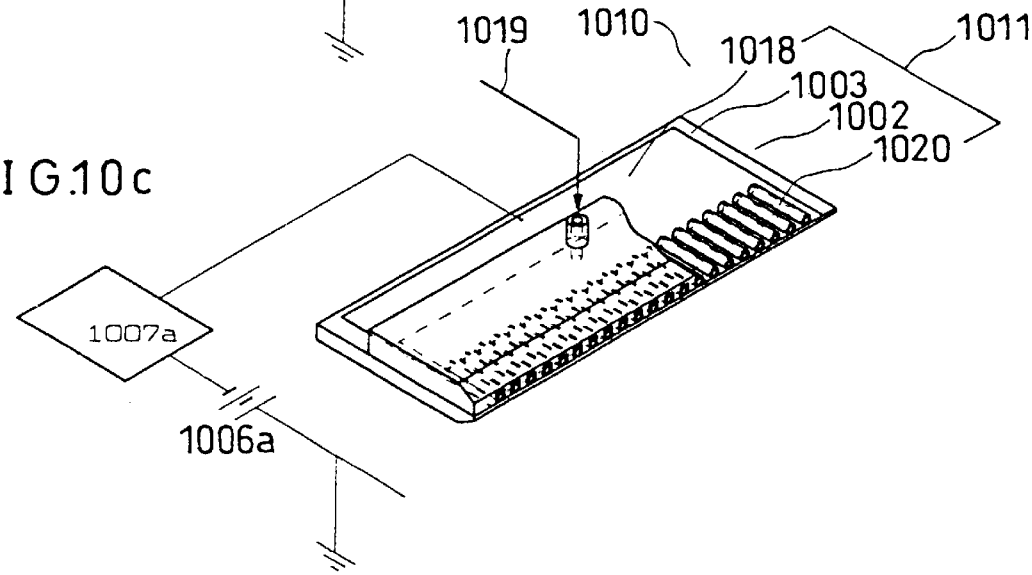

FIGS. 10*a*, 10*b*, 10*c* are perspective views showing three examples of configuration of a head portion 1011 constituted by an ejection port in the form of nozzles as described above.

First, the structure of the head portion in FIG. 10*a* will be described. The configuration, driving method and operation of the counter electrode portion will be omitted here because they are similar to those in the modes 1 and 2 for carrying out the invention.

1003 represents a lower substrate which serves as a base of a head portion 1011. A common electrode 1018 in the form of a thin film is formed in a wide range on the upper surface of the lower substrate 1003 and is wired to a high voltage power supply 1006*a* through a driving circuit 1007*a* which is driving means. The structural body of the head portion 1011 is formed by securing said lower substrate 1003 and upper substrate 1002 by means such as bonding with a spacer interposed.

An opening 1019 for supplying ink 1008 to said ink chamber is provided on the upper substrate 1003 and is connected to ink supply means (not shown) constituted by an ink supply tank and a supply tube.

A spacer portion is provided at the periphery of the lower surface of the upper substrate 1003 such that it surrounds the end face within the U-shaped configuration thereof to form an opening 1001 for ejecting ink. A wall having the same height as that of said spacer partitions the region of the opening 1001 as described above to form nozzle ports 1020 up to the end of the substrate and, therefore, the end of the substrate has a configuration like comb teeth.

By forming the head portion 111 by securing the head portion 1011 to said lower substrate 1002 and upper substrate, a gap having a constant height determined by the thickness of said spacer is formed between both substrates as an ink chamber to be filled with ink, and a plurality of nozzle ports 1020 are formed between the ink chamber and ink ejection port 1001.

In the head portion 1011, the ink 1008 is supplied by ink supply means 1019 through the ink chamber to the nozzle ports 1020 under a static pressure. The static pressure acting on the ink 1008 balances the surface tension of the ink at the nozzle ports 1020 and said ink forms a semilunar convex, i.e., meniscus and stays in this state.

Further, the region of the head portion 1011 forming the ejection port has a wedge-shaped section which is pointed toward the counter electrode portion and has a structure to provide a thin meniscus that causes electrical fields to concentrate on the ink.

In the present mode for carrying out the invention, glass substrates having insulating properties and high surface accuracy are used as the lower substrate 1103 and upper substrate 1002 of the head portion 1011 like the head portion in the mode 1 for carrying out the invention to configure the shape of the nozzle ejection ports 1020 accurately. While a method is used in which aluminum is vacuum-deposited on the upper surface of the lower substrate 1003 and a chemical etching process is performed thereafter on the aluminum thin film to form the common electrode 1018, this method of manufacture is not limiting like the head portion described in the mode 1 for carrying out the invention.

Next, a structure of a head portion in FIG. 10*b* will be described.

1003 represents a lower substrate which serves as a base of a head portion 1011. A common electrode 1018 in the form of a thin film is formed in a wide range on the upper surface of the lower substrate 1003 and is wired to a high voltage power supply 1006*a* through a driving circuit 1007*a* which is driving means. An upper substrate 1002 is secured on said lower-substrate 1003 by means such as bonding with a spacer having a uniform thickness interposed. At this time, the spacer is provided such that it surrounds the end face of the lower substrate 1003 within the U-shaped configuration thereof. With such a configuration of the head portion 1011, a gap having a constant height determined by the thickness of said spacer is formed between both of the substrates as an ink chamber to be filled with ink, and an opening 1001 is formed at a counter electrode portion 1012 facing the head portion 1011.

A nozzle plate 1020 which is a plate-like member having microscopic holes arranged in association with recorded pixels is provided at the opening of said opening 1001. Said nozzle plate 1020 is made of an insulating material, and a material which is resistant to the corrosion by an ink solvent must be chosen although there is no special limitation on it. For example, the use of polyethylene type and fluorine type resin materials or polymeric materials such as polyimide types as the material will provide preferable anti-chemical characteristics and will facilitate processing.

An opening 1019 for supplying ink 1008 to said ink chamber is provided on the upper substrate 1003 and is connected to ink supply means (not shown) constituted by an ink supply tank and a supply tube. The ink 1008 is supplied by ink supply means 1019 through the ink chamber to the ejection port 1001 under a static pressure. The static pressure acting on the ink 1008 balances the surface tension of the ink filled in the microscopic holes of the nozzle plate 1020 and said ink forms a semilunar convex, i.e., meniscus and stays in this state.

The use of the head portion 1011 having the above-described configuration makes it possible to easily form a circular nozzle portion without seams. This makes it possible to form a stable meniscus configuration and to perform stable ejection during ejection. Further, since the configuration is simple, the cost of the head portion can be reduced.

Next, a configuration of a head portion shown in FIG. 10*c* will be described.

1003 represents a lower substrate which serves as a base of a head portion 1011. A common electrode 1018 in the form of a thin film is formed in a wide range on the upper surface of the lower substrate 1003 and is wired to a high voltage power supply 1006*a* through a driving circuit 1007*a* which is driving means.

An array of grooves are provided on the lower surface of an upper substrate 1002, and metal nozzles 1020 which are conductive microscopic hollow pipes are secured and positioned in said grooves by means of such as bonding. Recesses are provided in positions behind said metal nozzles 1020 arranged on the lower surface of the upper substrate 1002, and said recesses are formed as ink chambers by forming the head portion 1011 in combination with said lower substrate 1003.

Since the common electrode 1018 on the lower substrate 1003 is secured to the metal nozzles 1020 using conductive adhesive or the like during the formation of the head portion 1011, they are in conduction to each other.

An opening 1019 for supplying ink to said ink chamber is provided, and ink supply means (not shown) constituted by an ink supply tank and a supply tube is connected to said ink chamber. The ink is supplied by the ink supply means 1019 through the ink chamber to the metal nozzles 1020 under a static pressure. The static pressure acting on the ink balances the surface tension of the ink filled in the microscopic holes of the metal nozzles 1020 through the ejection port and said ink forms a semilunar convex, i.e., meniscus and stays in this state.

As described above, a recording head utilizing those head portions has less physical interference between ink at adjoining ejecting positions like said recording head having the first configuration, and the directions of electric fields concentrate at the recording electrodes at the counter electrode portion. During the ejection of ink, therefore, ink is ejected substantially under no influence of turbulence of the electric fields attributable to interactions and stress in the ink attributable to surface tension, viscosity and the like between adjoining nozzles. As a result, a method of driving one line simultaneously as described above can be easily realized.

(Mode 3 for Carrying out the Invention)

Figure 4A:
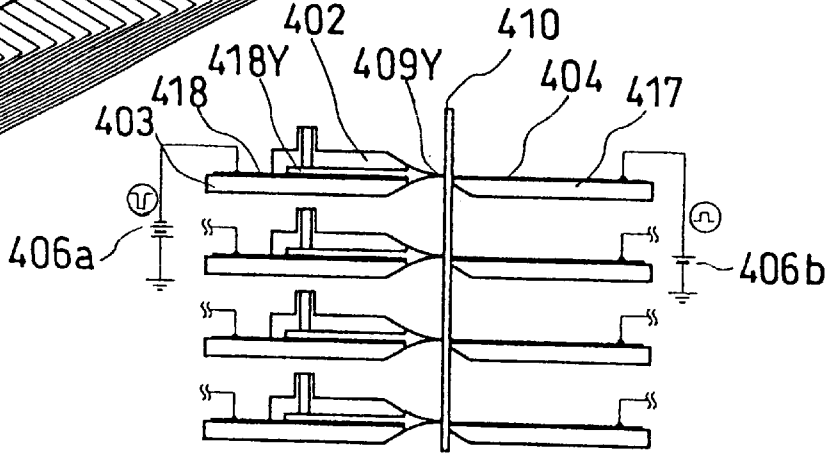
FIGS. 4*a* and 4*b* are illustrations showing a recording head for outputting a color image using the recording head shown in the mode 1 for carrying out the invention.
Figure 4B:
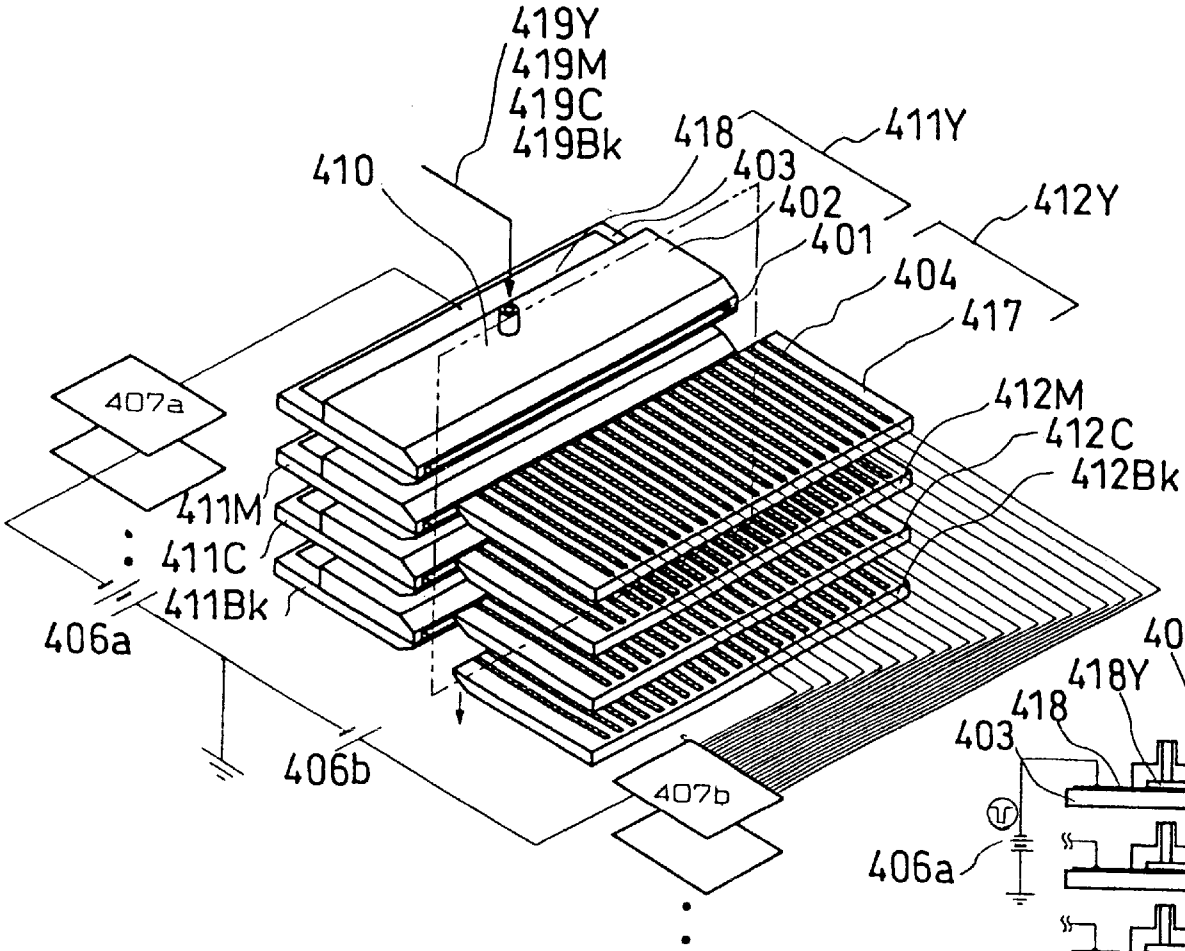

FIG. 4*a* is a side view and FIG. 4*b* is a perspective view showing a first configuration of a recording head for performing the recording of color images using a recording head according to the invention.

Four recording heads as described in the mode 1 for carrying out the invention are arranged in the direction in which paper is transported, and color ink is supplied to head portions 411Y, 411M, 411C, 411Bk of each recording head in the order of yellow (hereinafter "Y"), magenta (hereinafter "M"), cyan (hereinafter "C"), black (hereinafter "Bk") toward the paper transport direction. There is provided a counter electrode portion 412 for each of said head portions 411, i.e., 412Y, 412M, 412C, 412Bk are provided independently in a face-to-face relationship, and a driving circuit 107*a* which is driving means at the head portions 411 and a driving circuit 406*b* which is driving means at the counter electrode portions 412 are provided independently for each color.

Figure 7:
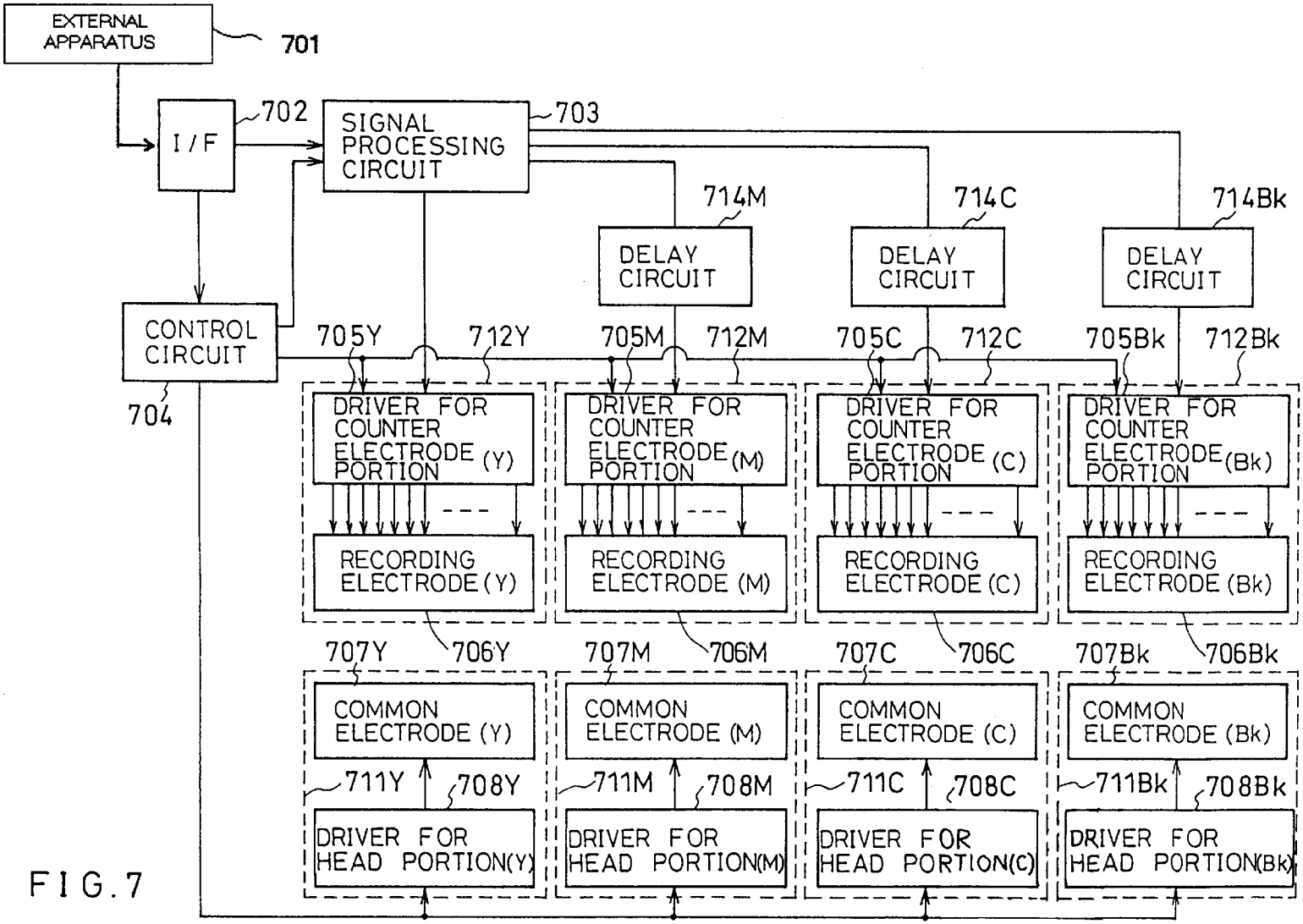
FIG. 7 is a block diagram showing an example of a driving method for outputting a color image in the configuration of a recording head shown in FIG. 4.

An example of a method for driving recording heads having the above-described configuration will now be described based on the block diagram shown in FIG. 7.

First, parallel signals output from an external apparatus 701 such as a PC terminal are input to an interface 702 which is a gateway as a recording apparatus, and control signals comprising parallel red, green, blue (hereinafter "R, G, B") image data signals, signals for controlling the apparatus and the like are output from said interface 702.

The parallel R, G, B image data signals output from said interface 703 are input to a signal processing circuit 703. The control signals output through said interface 702 are input to a control circuit 704 and are converted into a control signal for timing and operating each of said signal processing circuit 703, drivers 705Y, 705M, 705C, 705Bk for the counter electrode portions and drivers 708Y, 708M, 708C, 708Bk for the head portions in synchronism.

In response to the control signals from said control circuit 704, said signal processing circuit 703 converts the parallel R, G, B image data signals output from said interface 702 into Y, M, C, Bk serial binary signals in a parallel-serial conversion circuit and a color conversion circuit incorporated in said signal processing circuit 703 and inputs said image data signals to the respective drivers 705Y, 705M, 705C, 705Bk for the counter electrode portions associated with the respective colors.

At this time, since the slit ejection ports 401 of the recording heads are sequentially arranged at intervals toward the sub-scanning direction (hereinafter "recording head intervals"), the recording head of each color can not simultaneously record image data for recording of one line separated into each color on the recording paper. Therefore, the image data signal for each color from the signal processing circuit 703 is input to the counter electrode portion 705 at a predetermined time interval through a delay circuit 714 to cause delays corresponding to the recording head intervals.

This method is not limiting, and a memory may be provided in the signal processing circuit 703 or the like to store image data signals for the recording head intervals and data which have been associated with the recording head intervals in advance may be directly input to the drivers 705 for the counter electrode portions.

Said drivers 705 for the counter electrode portions independently incorporate a shift register type latch. Said image data signal in each color for recording of one line is set based on the input of this shift register and, thereafter, a control signal for driving recording of one line is output from the control circuit 704 to the recording head for each color. This driving operation causes the drivers 708 for the counter electrode portions to supply a constant voltage pulse having the positive polarity for recording of one line to each of the recording electrodes 706 simultaneously.

Similar control signals are input from the control circuit 704 to the drivers 708Y, 708M, 708C, 708Bk for the head portions in synchronism with the operation of driving said recording electrodes 706Y, 706M, 706C, 706Bk, and a constant voltage pulse having the polarity which is the reverse of that of the voltage applied to said recording electrodes 606 (negative polarity in this case) is supplied to common electrodes 707Y, 707M, 707C, 707Bk to drive them.

The voltage applied to the common electrode 707 in the head portion 711 for each color at this time is set at a negative polarity and an absolute voltage within the range of 1.5–2 kV, whereas the voltage applied to the recording electrodes 706 in the counter electrode portions 712 is set at a positive polarity and an absolute voltage within the range of 300–750 V. Further, a pulse application time of 1 ms was applied to both of them in synchronism, and driving was carried out with an application period of 3–4 ms.

After the above-described operation is completed, the recording paper is transported in the direction of the arrow by an amount which is determined by a predetermined resolution in the sub-scanning direction, and the same recording operation is repeated again thereafter in response to the next image data signal. Thus, an color image can be output on the recording paper in a range defined by the width of the recording heads and the scanned amount of the recording paper.

While the mode 4 for carrying out the invention has used recording heads having a structure as shown in the mode 1 for carrying out the invention, this is not especially limiting and the recording heads may be configured by combinating the head portions shown in FIGS. 10*a*, 10*b*, 10*c* previously described with the counter electrodes shown in FIGS. 3*a*, 3*b*.

(Mode 4 for Carrying out the Invention)

Figures 5A, 5B:
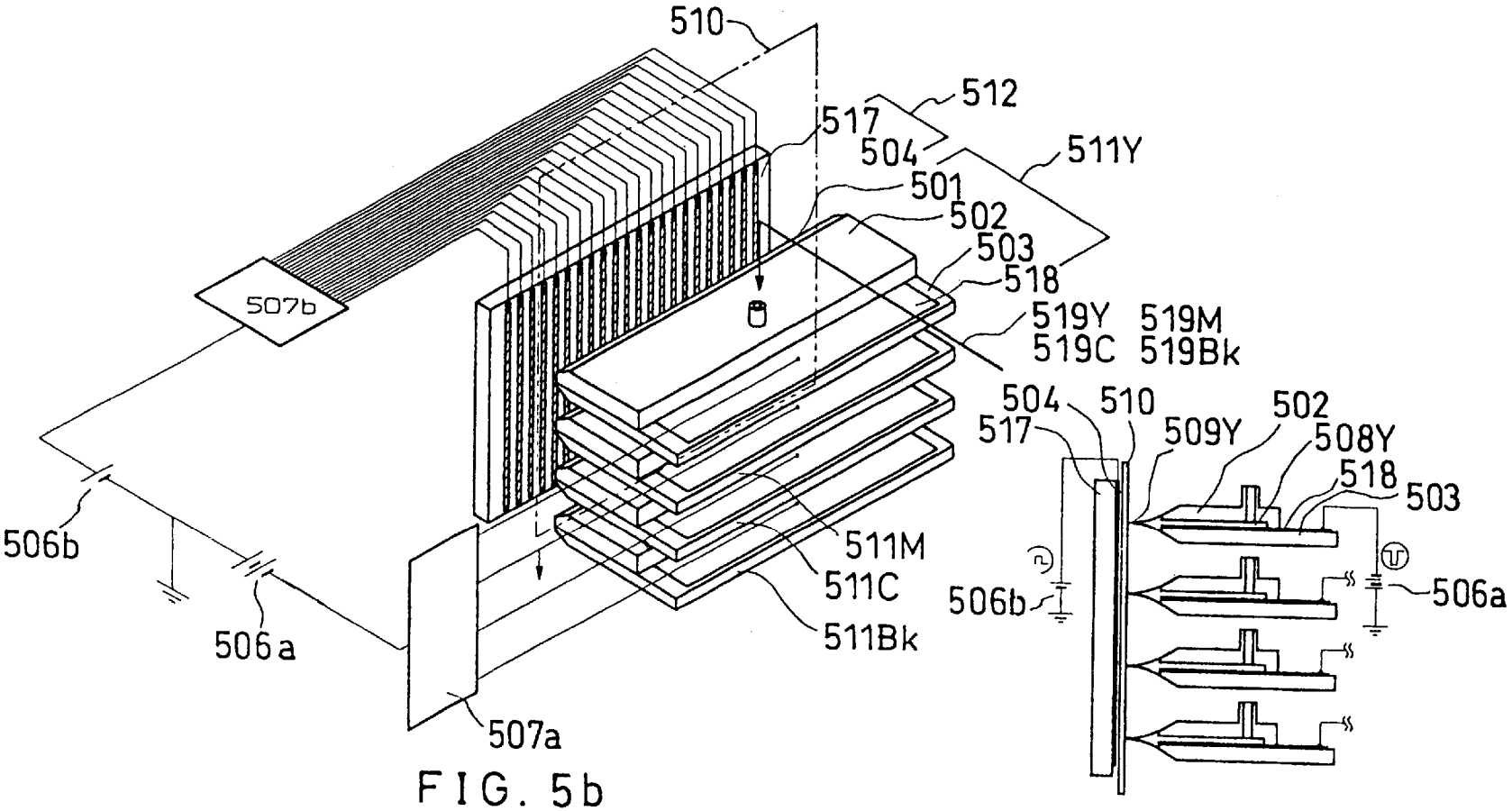
FIGS. 5*a* and 5*b* are illustrations showing a recording head for outputting a color image using the recording head shown in the mode 2 for carrying out the invention.

FIG. 5*a* is a side view and FIG. 5*b* is a perspective view showing a second configuration of a recording head for performing the recording of color images using a recording head according to the invention.

Four head portions 511 of recording heads as described in the mode 1 or 2 for carrying out the invention are arranged in the sub-scanning direction, and color ink is supplied to head portions 411Y, 411M, 411C, 411Bk of each recording head in the order of yellow (hereinafter "Y"), magenta (hereinafter "M"), cyan (hereinafter "C"), black (hereinafter "Bk") toward the paper transport direction. Further, a counter electrode portion 512 has the same configuration as that in the mode 2 for carrying out the invention, and one is provided for said four head portions 511 for each color and is disposed such that the face of recording electrodes 504 in said counter electrode portion 512 faces slit ejection portions 501 in said head portions 511 with a microscopic gap therebetween and orthogonally crosses all of common electrodes 507.

A driving circuit 507*a* which is driving means at the head portions 511 is independently provided for each color, whereas one common driving circuit 506*b* is provided which is driving means at the counter electrode portion 512.

Figure 8:
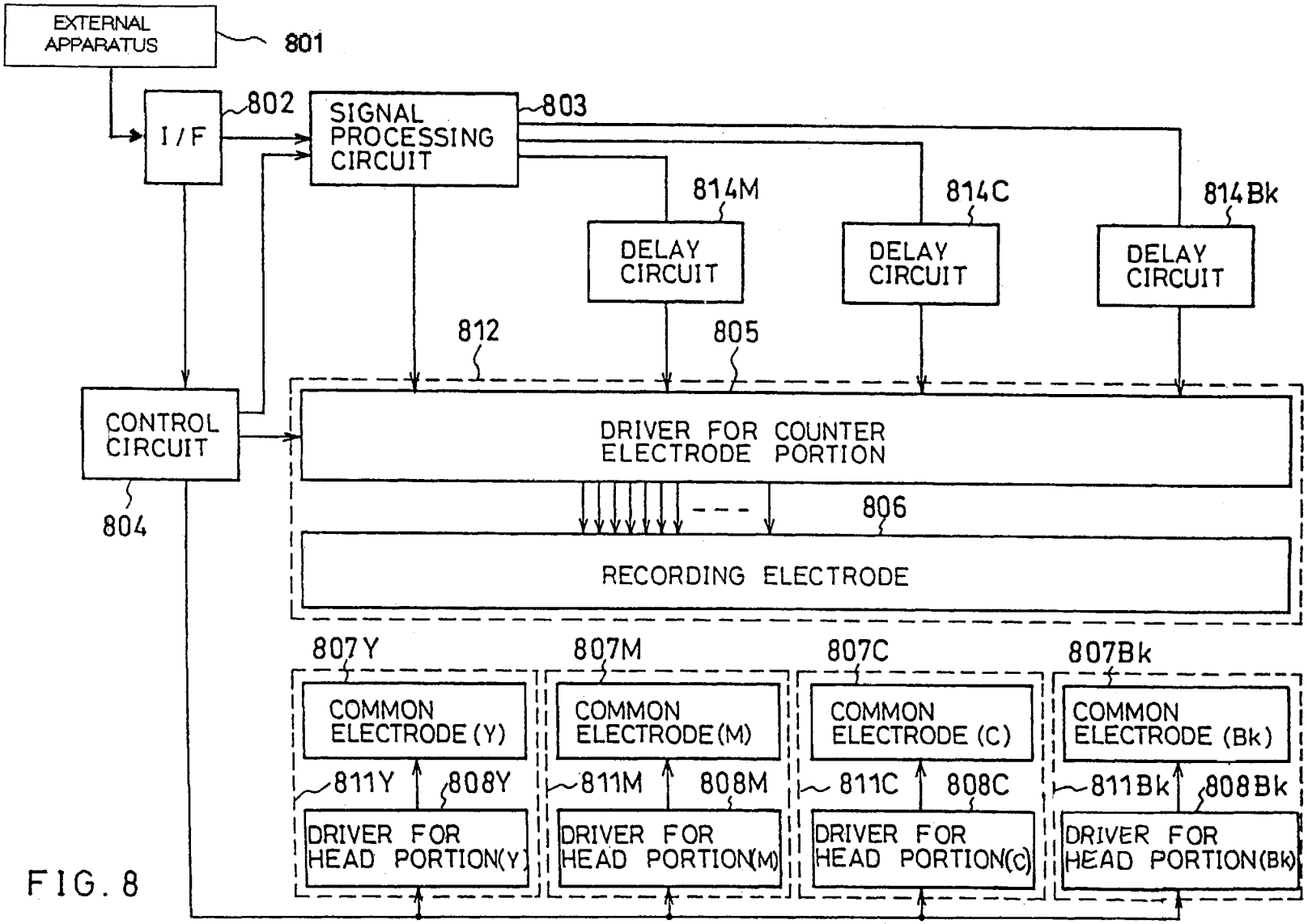
FIG. 8 is a block diagram showing an example of a driving method for outputting a color image in the configuration of a recording head shown in FIG. 5.
Figure 9A:
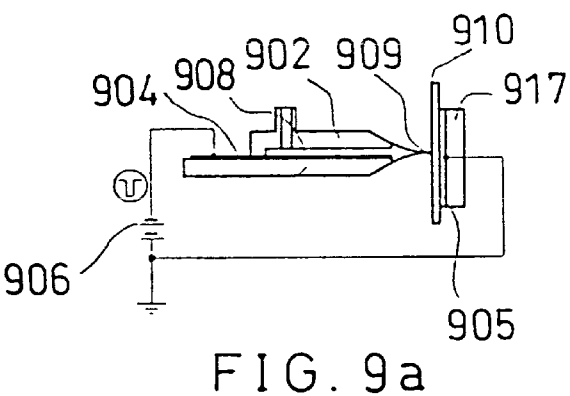
FIGS. 9*a* and 9*b* are illustrations showing a configuration of a recording head in a conventional slit-jet system.
Figure 9B:
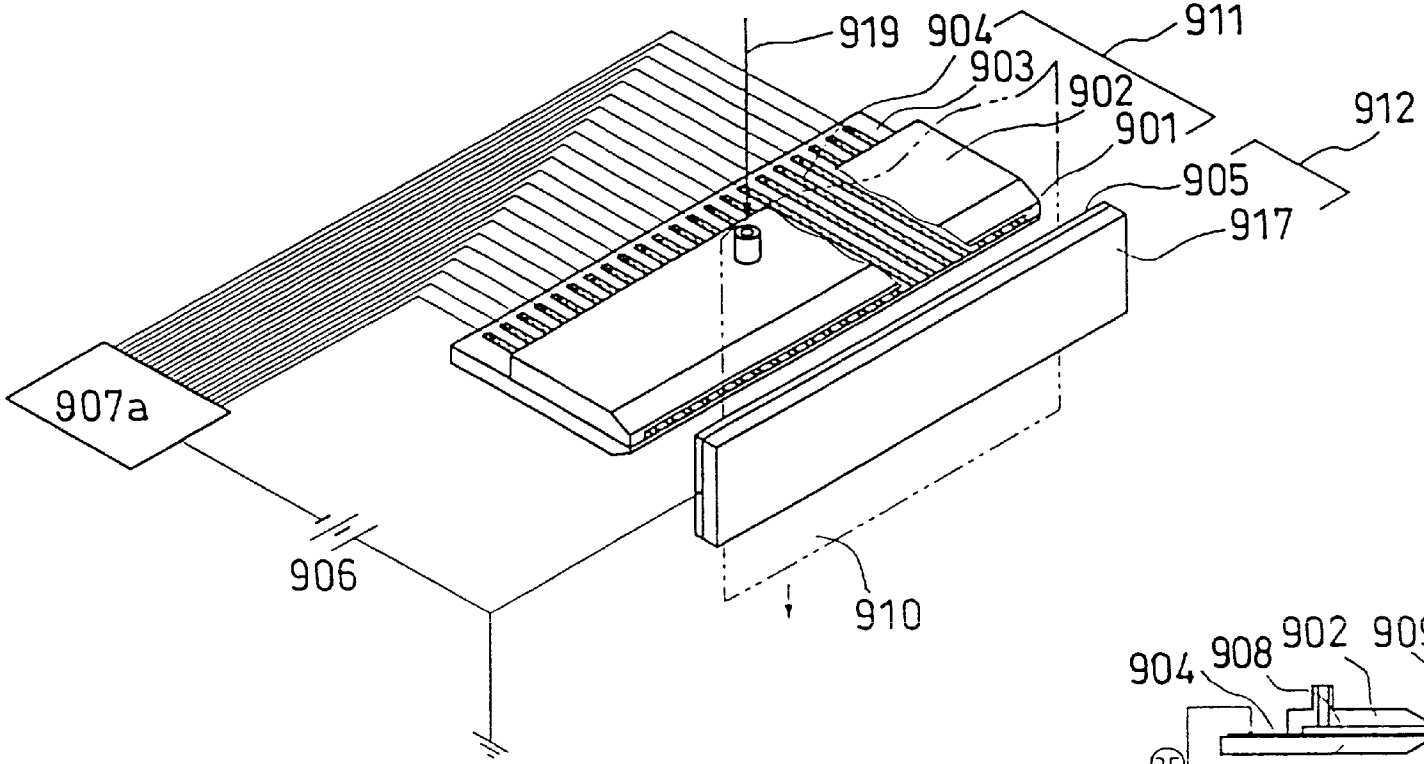

A description will now be made on an example of a method for driving recording heads configured as described above based on the block diagram shown in FIG. 8.

First, parallel signals output from an external apparatus 801 such as a PC terminal are input to an interface 802 which is a gateway as a recording apparatus, and control signals comprising parallel red, green, blue (hereinafter "R, G, B") image data signals, signals for controlling the apparatus and the like are output from said interface 802.

The parallel R, G, B image data signals output from said interface 803 are input to a signal processing circuit 803. The control signals output through said interface 802 are input to a control circuit 804 and are converted into a control signal for timing and operating each of said signal processing circuit 803, a driver 812 for the counter electrode portion and drivers 808Y, 808M, 808C, 808Bk for the head portions in synchronism.

In response to the control signals from said control circuit 804, said signal processing circuit 803 converts the parallel R, G, B image data signals output from said interface 802 into Y, M, C, Bk serial binary signals in a parallel-serial conversion circuit and a color conversion circuit incorporated in said signal processing circuit 803 and inputs said image data signals to a driver 805 for the counter electrode portion associated with each color.

At this time, the Y, M, C, Bk image data signals are controlled under the controlled from the control circuit 804 such that the image data signal of each color is sequentially scanned and input to the driver 805 for the counter electrode portion.

Therefore, the Y image data signal is first input to the driver 805 for the counter electrode portion and causes selective driving within the driver 805 for the counter electrode portion to supply a constant voltage pulse having the positive polarity for recording of one line to recording electrodes 806 simultaneously. A similar control signal is input to the driver 808Y for the head portions from the control circuit 804 in synchronism with the operation of driving said recording electrodes 806 to supply a constant voltage pulse having the polarity opposite to that of the voltage applied to said recording electrodes 806 (negative polarity here) to common electrodes 707Y to drive it.

Driving as described above is repeated for M, C, Bk in the order listed and, thereafter, transportation occurs in the direction of the arrow in an amount determined by a predetermined resolution in the sub-scanning direction. Thereafter, the same recording operation is repeated again in response to the input of the next image data signal. Thus, a color image can be output on the recording paper in a range defined by the width of the recording heads and the scanned amount of the recording paper.

While the present mode for carrying out the invention employs a matrix driving method in which the common electrode 518 for each color is sequentially scanned and driven in relation to the selectively driving of the recording electrodes 504 in the counter electrode portion 512, it is not particularly limited to this system. For example, a matrix driving system may be used in which, conversely, the recording electrodes 504 are sequentially scanned and driven one by one in relation to selective driving of the common electrodes 518.

Since the slit ejection ports 501 of the recording heads are sequentially arranged at intervals toward the sub-scanning direction (hereinafter "recording head intervals") as in the mode 3 for carrying out the invention, the recording head 511 for each color can not simultaneously record image data for recording of one line separated into each color on recording paper. It is therefore necessary to input the image data signal for each color from the signal processing circuit 803 to the driver 805 for the counter electrode portion at a predetermined time interval through the delay circuit 814 to cause delay associated with the recording head intervals or to input image data which have been associated with the recording head intervals in advance by providing a memory to the driver 805 for the counter electrode portion.

When the recording heads are formed by common electrodes and recording electrodes crossed with each other to perform matrix driving of the same as in this mode for carrying out the invention, since it is required to provide only one each counter electrode portion 512 and driving driver 507*b* which form fine recording electrode patterns, the size and cost of the color output apparatus can be reduced.

While this mode for carrying out the invention employs head portions of recording heads having a structure as described in the mode 1 or 2 for carrying out the invention, this is not especially limiting, and it is possible to use head portions having structures shown in FIGS. 1*a*, 10*b*, 10*c* previously described and to use a counter electrode portion having a structure as shown in FIG. 3*c*.

(Mode 5 for Carrying out the Invention)

Figure 11A:
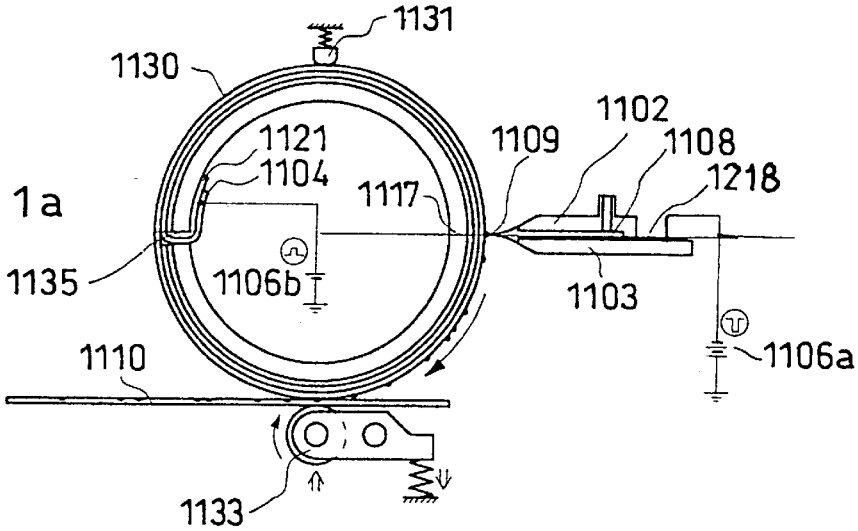
FIG. 11*a* is a side view and FIG. 11*b* is a perspective view showing a first configuration of an apparatus utilizing a recording head according to the invention and including an intermediate transfer medium and a retransfer mechanism.
Figure 11B:
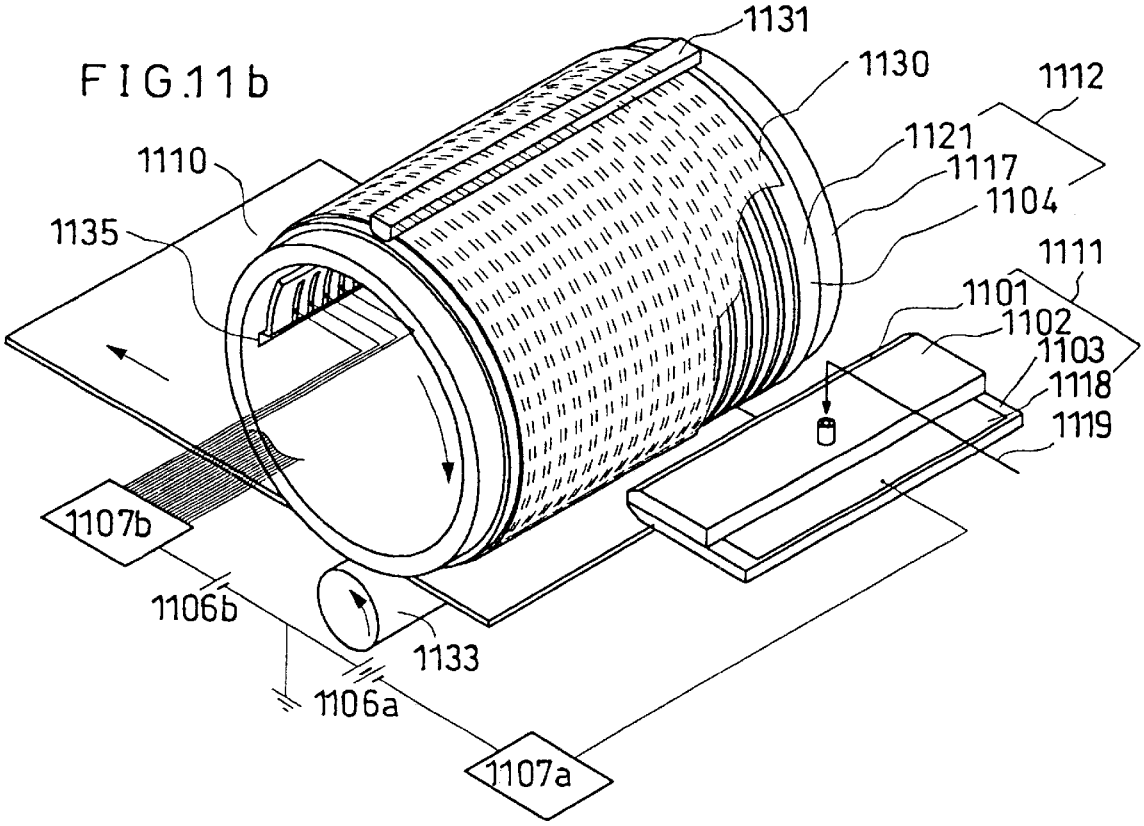

FIG. 11*a* is a side view and FIG. 11*b* is a perspective view showing a first configuration of an apparatus utilizing a recording head according to the invention and including an intermediate transfer medium and a retransfer mechanism.

A configuration of this apparatus will now be described.

Referring to the configuration of the recording head, the configuration described in the mode 1 for carrying out the invention is used for a head portion 1111; the configuration shown in FIG. 3*b* is used for a counter electrode portion 1112 facing said head portion 1111; and a flexible substrate 1121 formed with recording electrodes 1104 are wound around a supporting body 1117 in the form of a hollow drum to configure the counter electrode portion 1112 which is provided such that it orthogonally crosses a common electrode 1107 in the head portion 1111.

A bonding portion to a driver circuit 1107*b* on said flexible substrate 1121 is buried in the interior of the drum through a slit hole 1135 provided in one location on the circumferential surface of said supporting body 1117 and is connected to a driver circuit 1107*b* therefrom.

An intermediate transfer medium 1130 is formed in the form of a thin film on said flexible substrate 1121 to cover the recording electrode 1104. Said intermediate transfer medium 1130 is constituted by a dielectric having volume resistivity of $10^{12}$ Ω.cm or more, and polyester type resin that satisfies said characteristic conditions is used to coat the entire surface of the counter electrode. Any material that satisfies said condition for volume resistivity may be used, and preferable results of printing can be achieved by coating, for example, polyimide type resin, fluorine type resin and the like. The method for forming this intermediate transfer medium is not limited to this method, and a sheet-like dielectric film may be secured using methods such as bonding and contact bonding. Further, while the present mode for carrying out the invention employs a flexible substrate as a base material on which the recording electrodes 1104 are formed, the recording electrodes 1104 may be directly formed on the support body 1117 and the intermediate transfer medium 1130 may be configured on the surface thereof.

While scanning in the sub-scanning direction is carried out by rotating the support body 1117 in the form of a drum with the head portion 1111 fixed in this mode for carrying out the invention, this is not limiting and a flat plate may be linearly scanned instead. Further, obviously the head portion 1112 may be scanned with the counter electrode portion 1112 fixed.

Said supporting body 1117 is operated in the direction of the rotation by a driving system (not shown), and the flexible substrate 1121 secured on said support body 1117 and intermediate transfer medium 1130 rotate in the sub-scanning direction in synchronism with the driving of the head portion 1111. The rotating direction is clockwise as shown in the side view of FIG. 11*a*; rotatable pinch rollers 1133 are urged into contact with the intermediate transfer medium 1130 with a constant pressure downstream of the head portion; and there is a retransfer mechanism portion between both rollers where recording paper 1110 which is a recorded medium is inserted and where an ink image formed on said intermediate transfer medium 1130 is retransferred on to said recording paper 1110 by a pressure. A cleaner 1131 is urged into contact with the intermediate transfer medium 1130 downstream thereof to remove and clean residual ink, foreign substances and the like on the intermediate transfer medium 1130.

A description will now be made on a recording operation of the apparatus of this mode for carrying out the invention. The method for driving the recording head will not be described here because it is the same as that in the mode 1 for carrying out the invention.

When the apparatus issues a printing command, a cleaning operation is first carried out as an initial operation by an ejection port cleaning mechanism which is not shown on the slit ejection portion 1101 in the head portion 1111 to enable the recording head for the ejection of ink. When said cleaning operation is completed, the recording paper 1110 is transported to and put in a standby state at a point immediately before a inserting position into the gap between the drum-shaped counter electrode portion 1112 and the pinch rollers 1133 urged into contact therewith using a paper supply mechanism such as an automatic sheet feeder, a transport mechanism (not shown) utilizing a pair of rollers or the like and position detecting means such as a paper edge sensor.

When said initial operation is completed, the recording head performs a driving operation as described in the mode 1 for carrying out the invention to drive the intermediate transfer medium 1130 for recording of one line. Specifically, a constant voltage pulse having the negative polarity is applied to the common electrode 1104 on the head portion 1111 and, as a result, electric charges having the negative polarity are charged in the ink 1108 to generate negative charges on the entire surface of the region of a meniscus at the slit ejection port 1101. When a constant pulse having the positive polarity is applied to the recording electrodes 1104 in regions where printing is to take place simultaneously with this operation, the intermediate transfer medium 1130 in contact with said recording electrodes 1104 is polarized in electric fields generated between both electrodes because it is constituted by a dielectric and, as a result, the same number of positive and negative electric charges appear on both ends of the intermediate transfer medium 1130 in the sectional method thereof. In this case, since a pulse voltage having the positive polarity is applied to the recording electrodes 1104, electric charges having the negative polarity are generated on the surface of the intermediate transfer medium 1130 in contact with the recording electrodes 1104, and electric charges having the positive polarity are generated on the surface thereof toward the common electrode 1118 in positions corresponding to said recording electrodes 1104. At this time, the ink 1108 charged with the negative polarity at the slit ejection port 1101 receives a Coulomb force sufficient for ejection from the generation of the electric charges having the positive polarity on the surface of said intermediate transfer medium 1130 and the electric fields between both electrodes. As a result, ink 1109 is attracted by and flies toward the recording electrodes 1104 to which the voltage is applied and lands on the surface of the intermediate transfer medium 1130. A this time, since the electric fields generated between the common electrode 1118 and the recording electrodes 1104 converge at polarized regions generated on the intermediate transfer medium 1130, the ink lands in desired positions accurately.

After the recording of one line as described above, the intermediate transfer medium 1130 is transported in the direction of the arrow by an amount which is determined by a predetermined resolution in the sub-scanning direction by rotating said counter electrode portion 1112 clockwise by a predetermined amount, and the same recording operation is repeated for the second and subsequent lines. Thus, an actual ink image is formed on the intermediate transfer medium 1130. At this time, since the intermediate transfer medium 1130 is coated with a dielectric, the surface thereof is subjected to little fluctuations in the geometrical and electrical characteristics relative to the environment, i.e., the temperature and humidity, and the recording head always performs the ejecting operation on this medium. It is therefore possible to form stable ink images without controlling the voltage conditions and the like in accordance with the type of the recorded medium.

The ink image on said intermediate transfer medium 1130 is transported to the vicinity of the position of the retransfer mechanism downstream thereof as a result of driving of the counter electrode portion 1112. In accordance with this timing, said retransfer mechanism portion inserts the recording paper 1110 which has been in a standby state between a driving roller 1132 and the pinch roller 1133 and urges said ink image into contact with the recording paper 1110 through said intermediate transfer medium 1130 to transfer it, thereby provides a recorded image. The intermediate transfer medium 1130 after the transfer has a surface state which allows printing to be performed thereon again after removing residual ink, foreign substances and the like on the surface with the cleaner downstream of the retransfer mechanism portion. At this time, since the intermediate transfer medium 1130 constituted by a dielectric is easily charged as a result of friction or the like, a grounded antistatic brush or a conductive roller is preferably used in contact with the printing surface of the intermediate transfer medium 1130 to destaticize it. Although this method is not limiting and the use of a destaticizer utilizing the corona discharge phenomenon provides the same effect, it is necessary to perform the destaticizing operation at timing that does not affect the operation of driving the recording electrodes 1104 when said destaticizer is used in such a direct face-to-face relationship with the recording electrodes 1104 because the recording electrodes 1104 are wound around the circumferential surface of the supporting body 1117 on the drum.

(Mode 6 for Carrying out the Invention)

Figure 12A:
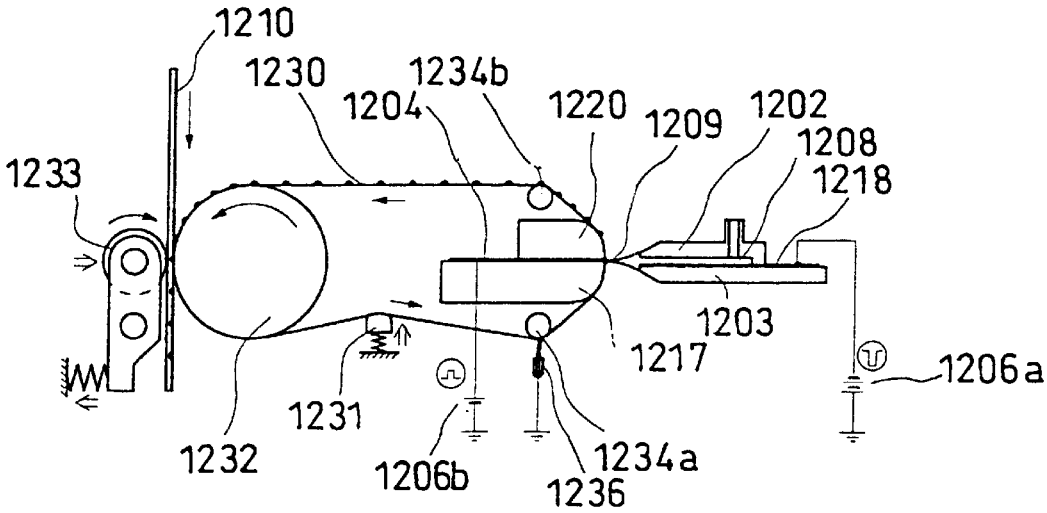
FIG. 12*a* is a side view and FIG. 12*b* is a perspective view showing a second configuration of an apparatus utilizing a recording head according to the invention and including an intermediate transfer medium and a retransfer mechanism.
Figure 12B:
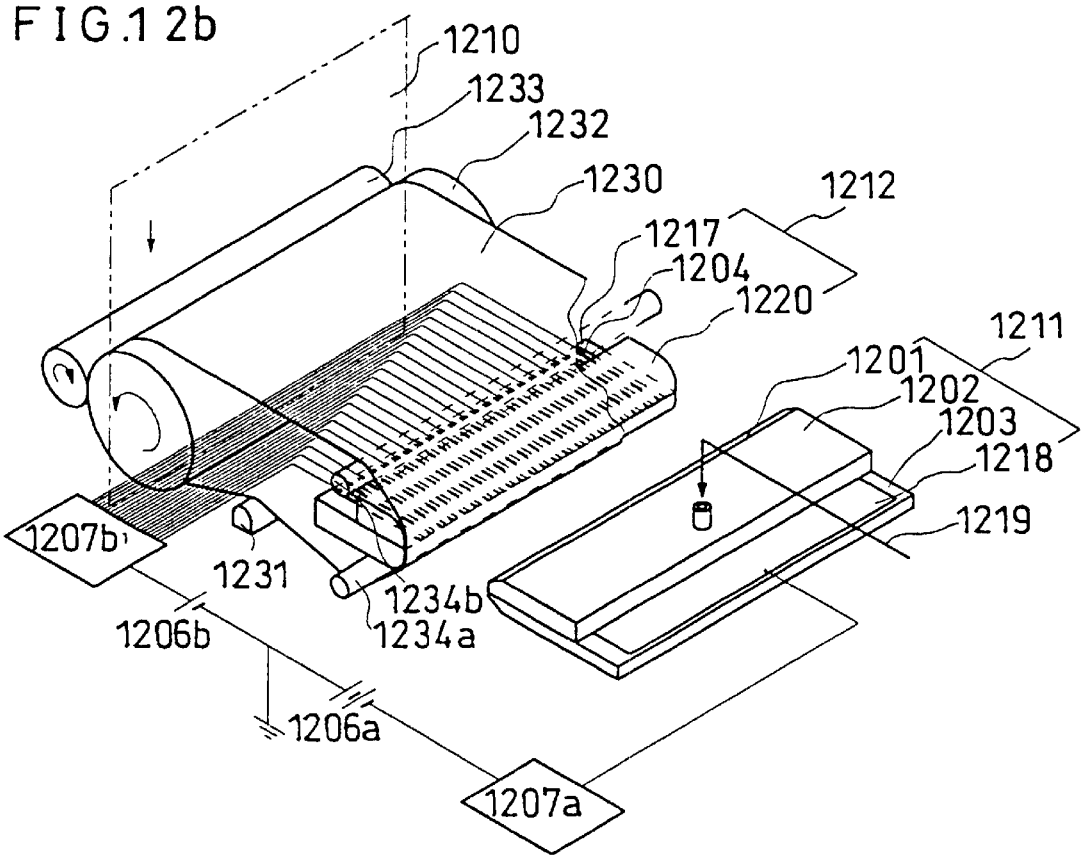

FIG. 12*a* is a side view and FIG. 12*b* is a perspective view showing a second configuration of an apparatus utilizing a recording head according to the invention and including an intermediate transfer medium and a retransfer mechanism.

A configuration of this apparatus will now be described.

Referring to the configuration of the recording head, the configuration described in the mode 1 for carrying out the invention is used for a head portion 1211; the configuration shown in FIG. 3*a* is used for a counter electrode portion 1212 facing said head portion 1211; and said counter electrode portion 1212 is disposed with the ends of recording electrodes 1204 facing common electrode 1207 in the head portion 1211. An intermediate transfer medium 1230 for temporarily receiving an ink image form the head portion 1211 is interposed in a microscopic gap provided between said head portion 1211 and counter electrode portion 1212.

Said intermediate transfer medium 1230 is formed in the form of a belt having a width substantially equal to or greater than the head portion 1211 in the longitudinal direction thereof and is stretched around a driving roller 1232 for belt-driving said intermediate transfer medium 1230, two rotatable guide rollers 1234*a*, 1234*b* provided above and under the counter electrode portion 1212 and the end of the counter electrode portion 1212. A cleaner 1231 is urged into contact with and between said driving roller 1232 and guide roller 1234*a* in the direction of inwardly urging the belt of the intermediate transfer medium 1230 from the outside to remove and clean residual ink, foreign substances and the like on the intermediate transfer medium 1130. Through such a function, the cleaner 1231 also plays the role of a belt tensioner that applies tension to the intermediate transfer medium 1230. However, a tensioner may be provided separately, and this example is not therefore limiting. A rotatable pinch roller 1233 is urged into contact with the driving roller 1232 for driving the intermediate transfer medium 1130 in the sub-scanning direction with a constant pressure. Recording paper 1210 which is a recorded medium is inserted between both rollers to form a retransfer mechanism portion for retransferring ink formed on said intermediate transfer medium 1230 to said recording paper 1210 with a pressure.

Preferably, said intermediate transfer medium 1230 is constituted by a dielectric film and has volume resistivity of $10^{12}$ (Ω·cm) or more. Here, polyimide was used as the material, which was electrically characterized by volume resistivity of $10^{17}$ Ω·cm (at 20° C.). Further, a higher dielectric constant gives a better result because it provides greater polarized electric charges. According to the present invention, it is preferably 2.0 (at 20° C. and 1 kHz) or more, and said polyimide has a dielectric constant of 3.5 (at 20° C. and 1 kHz). The smaller the thickness, the quicker the reaction of charge generation occurs during polarization. A better resolution will also be obtained on an electric latent image. In this mode for carrying out the invention in which driving is carried out in the form of a belt, mechanical strength can not be guaranteed; a greater thickness results in a reduction in the resolution of an electric latent image; the gap between the surface of the intermediate transfer medium 1230 and the head portion 1211 becomes very small to make it difficult to control the strength and distribution of electric fields; and, as a result, ink can be ejected in locations other than specified positions. Therefore, said intermediate transfer medium will provide a preferable function with a thickness of 500 Rm or less, preferably in the range of about 75–200 pm. While polyimide was used this time as the material for the intermediate transfer medium, this is not limiting and what is required is only to satisfy said conditions on the volume resistivity and dielectric constant. For example, the same effect can be achieved using a dielectric sheet of polyester (PET), pplyvinyl chloride (PVC), polycarbonate (PC), polyethylene (PE) or the like, a dielectric sheet made of fluorine type resin such as polyvinyl fluoride (PVF) or the like.

A description will now be made on a recording operation of the apparatus of this mode for carrying out the invention. The method for driving the recording head will not be described here because it is the same as that in the mode 1 for carrying out the invention.

When the apparatus issues a printing command, a cleaning operation is first carried out as an initial operation by an ejection port cleaning mechanism which is not shown on a slit ejection portion 1201 in the head portion 1211 to enable the recording head for the ejection of ink. When said cleaning operation is completed, the recording paper 1210 is transported to and put in a standby state at a point immediately before a inserting position into the gap between the driving roller 1232 and the pinch roller 1233 urged into contact therewith using a paper supply mechanism such as an automatic sheet feeder, a transport mechanism (not shown) utilizing a pair of rollers or the like and position detecting means such as a paper edge sensor.

When said initial operation is completed, the recording head performs a driving operation as described in the mode 1 for carrying out the invention to form an actual ink mage on the intermediate transfer medium 1230 in accordance with the same principle as that of the operation described in the mode 5 for carrying out the The ink image on said intermediate transfer medium 1230 is transported to the vicinity of the position of the retransfer mechanism as a result of driving of the driving roller 1232. In accordance with this timing, said retransfer mechanism portion inserts the recording paper 1210 which has been in a standby state between the driving roller 1232 and the pinch roller 1233 and urges said ink image into contact with the recording paper 1210 through said intermediate transfer medium 1230 to transfer it, thereby provides a recorded image. The intermediate transfer medium 1230 after the transfer has a surface state which allows printing to be performed thereon again after removing residual ink, foreign substances and the like on the surface with a cleaner downstream of the retransfer mechanism portion. A destaticizing mechanism 1236 utilizing an antistatic brush downstream thereof removes residual electric charges during printing and electric charges generated by charging as a result of friction with the cleaner and the like to maintain and stabilize the electrical characteristics during the printing of ink images on to the intermediate transfer medium 1130 at a constant state.

(Mode 7 for Carrying out the Invention)

Figure 13A:
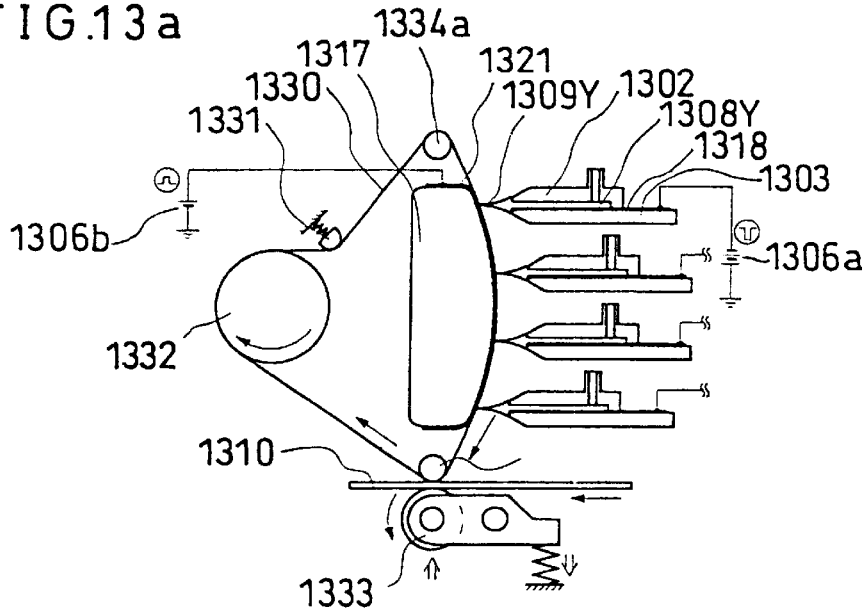
FIG. 13*a* is a side view and FIG. 13*b* is a perspective view showing a configuration of an apparatus for outputting a color image in the configuration of a recording apparatus shown in the mode 5 or 6 for carrying out the invention.
Figure 13B:
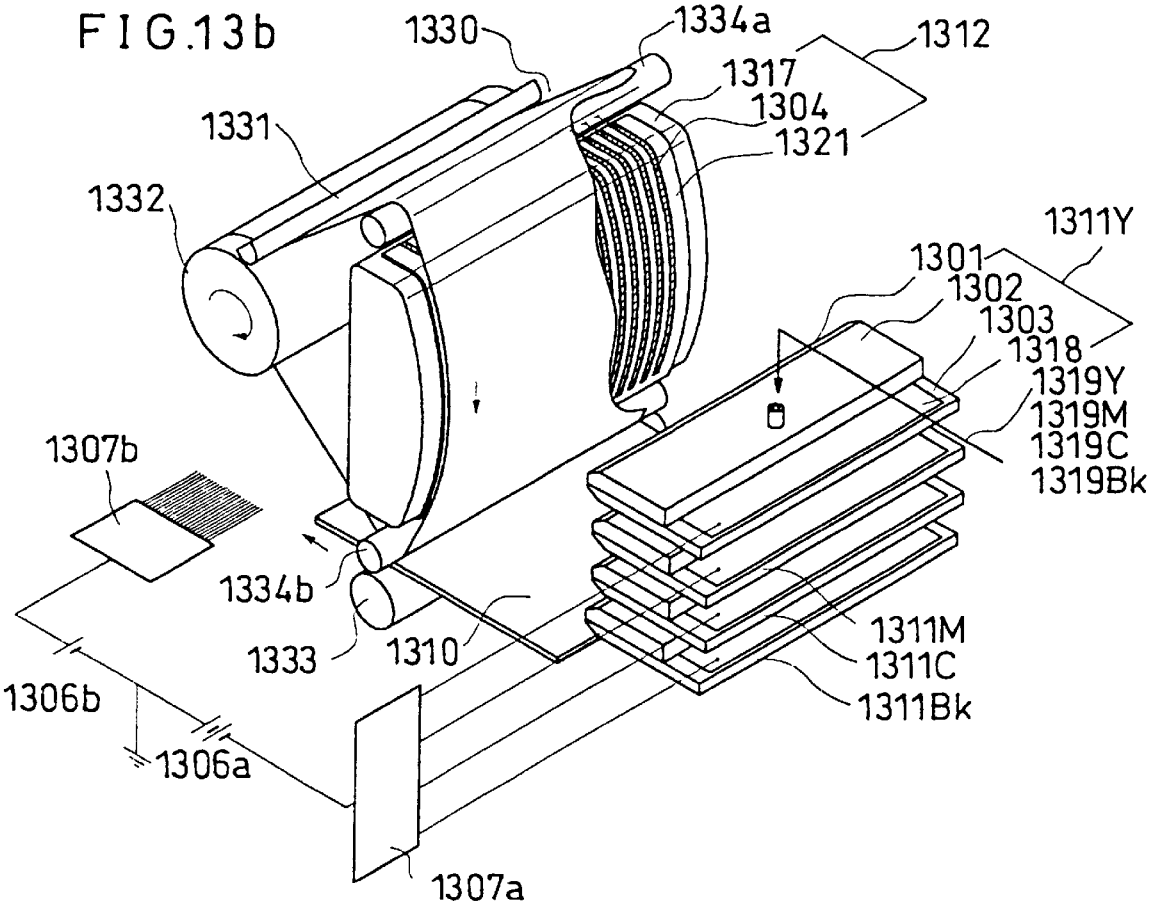

FIG. 13*a* is a side view and FIG. 13*b* is a perspective view showing a configuration of an apparatus for outputting color images with a configuration of a recording apparatus as shown in the mode 5 or 6 for carrying out the invention.

A configuration of the present apparatus will now be described.

Referring first to the configuration of recording heads, four recording heads 1311 as described in the mode 1 for carrying out the invention are used; four head portions 1311 are arranged in the sub-scanning direction; and color ink is supplied to head portions 1311Y, 1311M, 1311C, 1311Bk of each recording head in the order of yellow (hereinafter "Y"), magenta (hereinafter "M"), cyan (hereinafter "C"), black (hereinafter "Bk") toward the transport direction of an intermediate transfer medium 1330.

A counter electrode portion 1312 having the configuration shown in FIG. 3*b* is used in a face-to-face relationship with said head portion 1311. The counter electrode portion 1312 is configured by applying a flexible substrate 1321 to a supporting body 1317, and one is provided for said four head portions 1311 for each color and is disposed such that the face of recording electrodes 1304 in said counter electrode portion 1312 faces slit ejection portions 1301 in said head portions 1311 with a microscopic gap therebetween and orthogonally crosses all of common electrodes 1307. The intermediate transfer medium 1330 for temporarily receiving ink images from the head portions 1311 is interposed between a microscopic gap provided between said head portions 1311 and the counter electrode portion 1312.

Further, a driving circuit 1307*a* which is driving means at the head portions 1311 is independently provided for each color, whereas one common driving circuit 1306*b* is provided which is driving means at the counter electrode portion 1312.

Said intermediate transfer medium 1330 is constituted by a polyimide film having a thickness of 500 $\mu$m or less as in the mode 6 for carrying out the invention, is formed in the form of a belt having a width substantially equal to or greater than the head portion 1311 in the longitudinal direction thereof and is stretched around a driving roller 1332 for belt-driving said intermediate transfer medium 1330, two rotatable guide rollers 1334*a*, 1334*b* provided above and under the counter electrode portion 1312 and the end of the counter electrode portion 1312. A cleaner 1331 is urged into contact with and between said driving roller 1332 and guide roller 1334*a* in the direction of inwardly urging the belt of the intermediate transfer medium 1330 from the outside. Through such a function, it also plays the role of a belt tensioner that applies tension to the intermediate transfer medium 1330 as shown in the mode 6. A rotatable pinch roller 1333 is urged into contact with the guide roller 1334*b* with a constant pressure to form a retransfer mechanism portion. Recording paper 1310 which is a recorded medium is inserted between both rollers to retransfer the ink formed on said intermediate transfer medium 1330 to said recording paper 1310 with a pressure.

The recording apparatus having the above-described configuration can form a color ink image on the intermediate transfer medium 1330 through the method of driving the recording head shown in the mode 4 for carrying out the invention and the recording operation of the apparatus shown in the mode 6 for carrying out the invention to output a color image by transferring said ink image on to the recording paper 1310 with said retransfer mechanism.

The present invention is carried out in the above-described modes and provides effects as described below.

(1) A head portion of a recording head serves as a common electrode, and divided recording electrodes are provided at a counter electrode, which improves yield because the structure of the head portion can be simplified to relax limitations on manufacture. It is therefore possible to improve maintainability of a recording head and to reduce the manufacturing cost. Further, the simplified configuration of the structure of a head portion makes it possible to fabricate a long line head and to significantly shorten the recording speed for high speed printing by performing plane scanning on recording paper with this line head.

(2) Since divided recording electrodes are provided at a counter electrode, they will not contact ink and an insulation treatment can be provided on the surface of the recording electrodes. This makes it possible to prevent deterioration of the recording electrodes and discharge between adjoining electrodes, thereby to expand the life of the recording head. In addition, since a great potential difference can be established between recording electrodes that cause the ejection of ink and recording electrodes that do not cause the ejection of ink because of a high level of insulation achievable between adjoining electrodes, selectivity of ink ejecting positions can be stabilized.

(3) Since electric fields concentrate at recording electrodes on a counter electrode which are the end point in the ink ejecting direction, the accuracy of the landing positions of ink is improved to allow the quality of an output image to be improved.

(4) A color image output can be easily obtained by stacking recording heads vertically and by driving each of them independently.

(5) A color image can be output by stacking a plurality of head portions vertically in a recording head, providing one counter electrode portion for said plurality of head portions and performing matrix driving of both electrodes. This significantly simplifies the configuration of an apparatus and allows reductions in size and cost of a color image output apparatus.

(6) The use of a head portion having an ejection port constituted by a plurality of nozzle ports eliminates physical interference such as continuation of ink at adjoining ejecting positions because ink is reliably independently separated at least in the positions of the nozzles. Further, the directions of electric fields concentrate in recording electrodes at a counter electrode as previously described. For example, in a line head configuration, this makes it possible to drive it for one line simultaneously, thereby to achieve an increase in the recording speed.

By employing an intermediate transfer medium and a retransfer mechanism as shown in the modes 5 through 7 for carrying out the invention as a configuration of a repcording apparatus:

(7) printing conditions such as an application voltage are only required to be adjusted for the intermediate transfer medium because the head portion performs printing always on the intermediate transfer medium of the same material; a recorded medium can be made at least less subject to expansion and contraction than those based on paper by forming the intermediate transfer medium with a dielectric; and stable output images can always be obtained regardless of the environment and the like because water absorption is substantially eliminated to reduce the effects on geometrical and electrical characteristics attributable to temperature and humidity. In addition, since final printing is performed by transferring an ink image on said intermediate transfer medium to a recorded medium with retransfer means, an image can be output regardless of the type of the recorded medium.

(8) Steps in this configuration are spatially divided into a recording step for forming an ink image from a head portion to an intermediate transfer medium, a transfer step for retransferring the ink image on said intermediate transfer medium to a recorded medium and the like. This eliminates the need for inserting the recorded medium in a microscopic gap formed between the head portion and a counter electrode and consequently the need for a complicated transfer mechanism as in the prior art, thereby allowing a reduction of the cost of an apparatus. Furthermore, since this eliminates the need for inserting a recorded medium in the gap between both electrodes, smear on the recorded medium due to contact between the recorded medium and the head portion during transportation as in the prior art is completely eliminated. Moreover, preferable printing with good reproducibility can be carried out because printing can be carried out without disturbing the distribution of field strength when an ink image is formed on the intermediate transfer medium.

What is claimed is:

1. An electrostatic-type inkjet recording head comprising:

a head portion having an ink chamber for storing ink, an ink ejection port for ejecting ink stored in the ink chamber, and a common electrode disposed proximate the ink ejection port for supplying electric charges to the ink in the ink chamber to generate an electrostatic force for ejecting the ink from the ink ejection port;

ink supply means for supplying ink to the ink chamber;

a counter electrode disposed opposite to and spaced-apart from the common electrode and proximate the ink ejection port of the head portion to form a microscopic gap between the counter electrode and the ink ejection port for receiving a recording medium;

a plurality of recording electrodes disposed on a surface of the counter electrode as divisions associated with pixels of a recorded image, each of the recording electrodes extending generally perpendicular to a lengthwise direction of the common electrode;

voltage supply means for applying predetermined voltages between the common electrode and the recording electrodes; and driving means for driving the recording electrodes by independently controlling the voltage applied to each of the recording electrodes in accordance with an image signal.

2. An electrostatic-type inkjet recording head according to claim 1; wherein the ink ejection port of the head portion comprises a slit-shaped opening.

3. An electrostatic-type inkjet recording head according to claim 1; wherein the ink ejection port of the head portion comprises a plurality of openings each having a nozzle corresponding to a respective one of the pixels of the recording electrodes.

4. An image recording apparatus comprising:

an electrostatic-type inkjet recording head according to claim 1; and recording paper transport means for supplying recording paper to the microscopic gap between the counter electrode and the ink ejection port of the head portion and for scanning the recording paper in synchronism with the driving of the recording electrodes.

5. An image recording apparatus comprising: an electrostatic-type inkjet recording head according to claim 1; an intermediate transfer medium disposed on a surface of the counter electrode for receiving a recorded image; and retransfer means for causing ink dots ejected from the ejection port of the head portion of the electrostatic-type inkjet recording head to temporarily adhere onto a surface of the intermediate transfer medium to transfer a desired image.

6. An image recording apparatus according to claim 5; further comprising cleaning means for removing residual ink adhered to the surface of the intermediate transfer medium.

7. An inkjet recording apparatus according to claim 5; wherein the intermediate transfer medium comprises a dielectric body having a volume resistivity of $10^{12}$ Ω.cm or more.

8. An image recording apparatus according to claim 7; further comprising cleaning means for removing residual ink adhered to the surface of the intermediate transfer medium.

9. An inkjet recording apparatus according to claim 5; wherein the intermediate transfer medium comprises film of a dielectric material having a volume resistivity of $10^{12}$.Ω cm or more.

10. An image recording apparatus according to claim 9; further comprising cleaning means for removing residual ink adhered to the surface of the intermediate transfer medium.

11. An image recording apparatus comprising:

a plurality of electrostatic-type inkjet recording heads according to claim 1 each disposed independently of and in parallel relation relative to one another so that the microscopic gaps between the counter electrodes and the ink injection ports of the head portions are aligned, the ink supply means of each electrostatic-type inkjet recording head including means for supplying ink to the ink chamber in a color different from the color of the ink supplied by each of the other ink supply means; and recording paper transport means for supplying recording paper to the microscopic gaps disposed between the counter electrodes and the ink ejection ports of the head portions and for scanning the recording paper in synchronism with the driving of the recording electrodes of each of the recording heads to thereby record on the recording paper a recorded image having different colors.

12. A recording head comprising: a head portion having an ink chamber for storing colored ink, an ink ejection port for ejecting the colored ink stored in the ink chamber, and a common electrode for supplying electric charges to the colored ink in the ink chamber to generate an electrostatic force for ejecting the colored ink from the ink ejection port; ink supply means for supplying the colored ink to the ink chamber of the head portion; a counter electrode disposed opposite to and spaced-apart from the common electrode and proximate the ink ejection port of the head portion to form a microscopic gap between the counter electrode and the ink ejection port for receiving a recording medium; a plurality of recording electrodes disposed on a surface of the counter electrode, each of the recording electrodes extending generally perpendicular to a lengthwise direction of the common electrode; and driving means for driving the common electrode and the recording electrodes to generate an electrostatic force for electrically charging the colored ink stored in the ink chamber so that the electrically charged colored ink flows from the ink chamber, is ejected through the ejection port, and is outputted onto the recording medium.

13. An image recording apparatus comprising: a plurality of recording heads according to claim 12, the recording heads being stacked in parallel relationship so that the microscopic gap of each recording head is aligned with the microscopic gap of each of the other recording heads in a direction generally perpendicular to the recording electrodes, the ink supply means of each recording head including means for supplying ink of a color different than the ink supplied by the ink supply means of each of the other recording heads; and recording paper transport means for supplying recording paper to the aligned microscopic gaps of the stacked recording heads and for scanning the recording paper in synchronism with the driving of the recording electrodes of each of the recording heads to thereby record on the recording paper a recorded image having different colors.

14. A recording head comprising: a head portion having a common electrode, an ink chamber for storing ink, and an ink ejection port; a counter electrode disposed opposite to and spaced-apart from the common electrode and proximate the ink ejection port of the head portion to form a gap between the counter electrode and the ink ejection port for receiving a recording medium, the counter electrode having a plurality of recording electrodes extending generally perpendicular to a lengthwise direction of the common electrode; a power source for applying a voltage between the common electrode and the counter electrode to generate an electric field therebetween; and control means for controlling the voltage applied between the common electrode and the counter electrode to generate an electrostatic force for electrically charging the ink stored in the ink chamber so that the electrically charged ink flows from the ink chamber, is ejected through the ejection port, and is outputted onto the recording medium.

15. A recording head according to claim 14; further comprising ink supply means for supplying ink to the ink chamber.

16. In an ink jet recording apparatus for outputting ink onto a recording medium, a recording head as claimed in claim 14 for ejecting and outputting the ink onto the recording medium.

* * * * *